US011359855B2

(12) United States Patent
Roh et al.

(10) Patent No.: US 11,359,855 B2
(45) Date of Patent: Jun. 14, 2022

(54) REFRIGERATOR AND CONTROLLING METHOD THEREOF

(71) Applicant: Samsung Electronics Co., Ltd., Suwon-si (KR)

(72) Inventors: Hee Yuel Roh, Suwon-si (KR); Kook Jeong Seo, Suwon-si (KR); In Sub Lee, Suwon-si (KR); Dae Whan Kim, Suwon-si (KR); Jeong-Min Jeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 204 days.

(21) Appl. No.: 16/697,606

(22) Filed: Nov. 27, 2019

(65) Prior Publication Data

US 2020/0173709 A1 Jun. 4, 2020

(30) Foreign Application Priority Data

Nov. 30, 2018 (KR) ..... 10-2018-0151534

(51) Int. Cl.
*F25D 21/12* (2006.01)
*F25D 21/00* (2006.01)

(52) U.S. Cl.
CPC ..... *F25D 21/125* (2013.01); *F25D 21/008* (2013.01)

(58) Field of Classification Search
CPC ..... F25D 21/125; F25D 21/008; F25D 2317/067; F25D 21/08; F25D 17/067; F25D 21/006; F25D 2700/12
See application file for complete search history.

(56) References Cited

U.S. PATENT DOCUMENTS

2017/0248360 A1 8/2017 Tao et al.

FOREIGN PATENT DOCUMENTS

| | | |
|---|---|---|
| CN | 107421215 | 12/2017 |
| EP | 2559960 | 2/2013 |
| JP | 2017-32150 | 2/2017 |
| KR | 10-1994-0009644 | 5/1994 |
| KR | 20-0122354 | 5/1998 |

(Continued)

OTHER PUBLICATIONS

International Search Report dated Mar. 24, 2020 in International Patent Application No. PCT/KR2019/016192.

(Continued)

*Primary Examiner* — Lionel Nouketcha
(74) *Attorney, Agent, or Firm* — Staas & Halsey LLP

(57) ABSTRACT

A refrigerator includes a storage compartment; a first flow path separated from the storage compartment; an evaporator provided on the first flow path to cool air; a compressor configured to discharge a refrigerant to the evaporator; a blower fan configured to discharge air of the first flow path to the storage compartment; a defrost heater provided on the first flow path to heat the evaporator; a second flow path separated from the first flow path; a defrost fan configured to suction air of the first flow path into the second flow path; and a controller configured to alternately perform a cooling operation and a defrosting operation, configured to operate the compressor and the blower fan during the cooling operation, configured to operate the defrost heater and the defrost fan during the defrosting operation, and configured to vary a rotational speed of the defrost fan.

15 Claims, 15 Drawing Sheets

(56) References Cited

FOREIGN PATENT DOCUMENTS

| | | | | |
|---|---|---|---|---|
| KR | 10-1999-024856 | | | 4/1999 |
| KR | 10-1999-0054080 | | | 7/1999 |
| KR | 10-2010-0085228 | | | 7/2010 |
| KR | 20100085228 | A | * | 7/2010 |
| KR | 10-2011-0055047 | | | 5/2011 |
| KR | 10-1450664 | | | 10/2014 |
| KR | 10-2019-0114287 | | | 10/2019 |
| WO | 2005/052474 | | | 6/2005 |
| WO | 2014/147075 | | | 9/2014 |

OTHER PUBLICATIONS

Extended European Search Report dated Apr. 24, 2020 in European Patent Application No. 19212975.7.

* cited by examiner

REFRIGERATOR AND CONTROLLING METHOD THEREOF

CROSS-REFERENCE TO RELATED APPLICATION(S)

This application is based on and claims priority under 35 U.S.C. § 119 to Korean Patent Application No. 10-2018-0151534, filed on Nov. 30, 2018, in the Korean Intellectual Property Office, the disclosure of which is incorporated by reference herein in its entirety.

BACKGROUND

1. Field

The disclosure relates to a refrigerator and a control method thereof, and more particularly, to a refrigerator having a defroster capable of improving the defrosting efficiency and a control method thereof.

2. Description of Related Art

In general, a refrigerator supplies cold air generated by an evaporator to a storage compartment to maintain the freshness of various foods for a long time. The storage compartment of the refrigerator is divided into a refrigerating compartment maintained at approximately 3° C. to store food in a refrigerated state, and a freezing compartment maintained at approximately −20° C. to store food in a frozen state.

Particularly, the refrigerator is provided with an evaporator configured to absorb ambient heat while evaporating a low pressure and low temperature refrigerant, so as to exchange heat with indoor air in the storage compartment. In this case, water vapor that is introduced from the outside at the room temperature, or water vapor that is evaporated from the water contained in food stored in the refrigerator may be changed into frost on an outer surface of the evaporator having a low temperature, due to the temperature difference therebetween.

Because the frost on the outer surface of the evaporator lowers the heat exchange efficiency, lowers the cooling efficiency of the refrigerator, and increases the power consumption, a defroster for removing the frost is provided in the refrigerator.

The defroster may remove the frost of the evaporator using a heater. At this time, the heater is located below the evaporator, and thus a temperature difference occurs between the lower side of the evaporator and the upper side of the evaporator. Therefore, it leads to difficulties in that energy more than necessary is used, the defrost energy increases and power consumption of the refrigerator increases.

Further, there is a difficulty in that the temperature of the storage compartment is raised, thereby deteriorating performance of the food storage.

SUMMARY

Therefore, it is an aspect of the disclosure to provide a refrigerator including a defroster capable of improving the defrosting efficiency.

It is an aspect of the disclosure to provide a refrigerator capable of improving power consumption by minimizing defrost energy by shortening a defrost time.

It is an aspect of the disclosure to provide a refrigerator capable of improving performance of the food storage by preventing an increase in a temperature of a storage compartment caused by defrost heat.

Additional aspects of the disclosure will be set forth in part in the description which follows and, in part, will be apparent from the description, or may be learned by practice of the presented embodiments.

In accordance with an aspect of the disclosure, a refrigerator includes a storage compartment; a first flow path separated from the storage compartment; an evaporator provided on the first flow path; a compressor configured to discharge a refrigerant to the evaporator; a blower fan configured to discharge air of the first flow path to the storage compartment; a defrost heater provided on the first flow path to heat the evaporator; a second flow path separated from the first flow path; a defrost fan configured to suction aft of the first flow path into the second flow path; and a controller configured to alternately perform a cooling operation and a defrosting operation; configured to operate the compressor and the blower fan during the cooling operation, configured to operate the defrost heater and the defrost fan during the defrosting operation, and configured to vary a rotational speed of the defrost fan.

In accordance with an aspect of the disclosure, a control method of a refrigerator including a storage compartment; a first flow path separated from the storage compartment, and a second flow path separated from the first flow path, the control method includes during a cooling operation, cooling air of the first flow path by an evaporator by operating a compressor, and discharging the air of the first flow path to the storage compartment by a blower fan, and during a defrosting operation, heating the evaporator by a defrost heater and suctioning the air of the first flow path into the second flow path by a defrost fan. A rotational speed of the defrost fan is variable.

In accordance with an aspect of the disclosure, a refrigerator includes a storage compartment, a first flow path separated from the storage compartment, an evaporator provided on the first flow path, a compressor configured to discharge a refrigerant to the evaporator, a blower fan configured to discharge air of the first flow path to the storage compartment, a defrost heater provided on the first flow path to heat the evaporator, a second flow path separated from the first flow path, a defrost fan configured to suction air of the first flow path into the second flow path, and a controller configured to alternately perform a cooling operation and a defrosting operation, configured to operate the compressor and the blower fan during the cooling operation, and configured to operate the defrost heater and the defrost fan during the defrosting operation. The controller operates the defrost heater when a first time is elapsed since the compressor and the blower fan are stopped, and the controller operates the defrost fan for a second time after the defrost heater is stopped.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
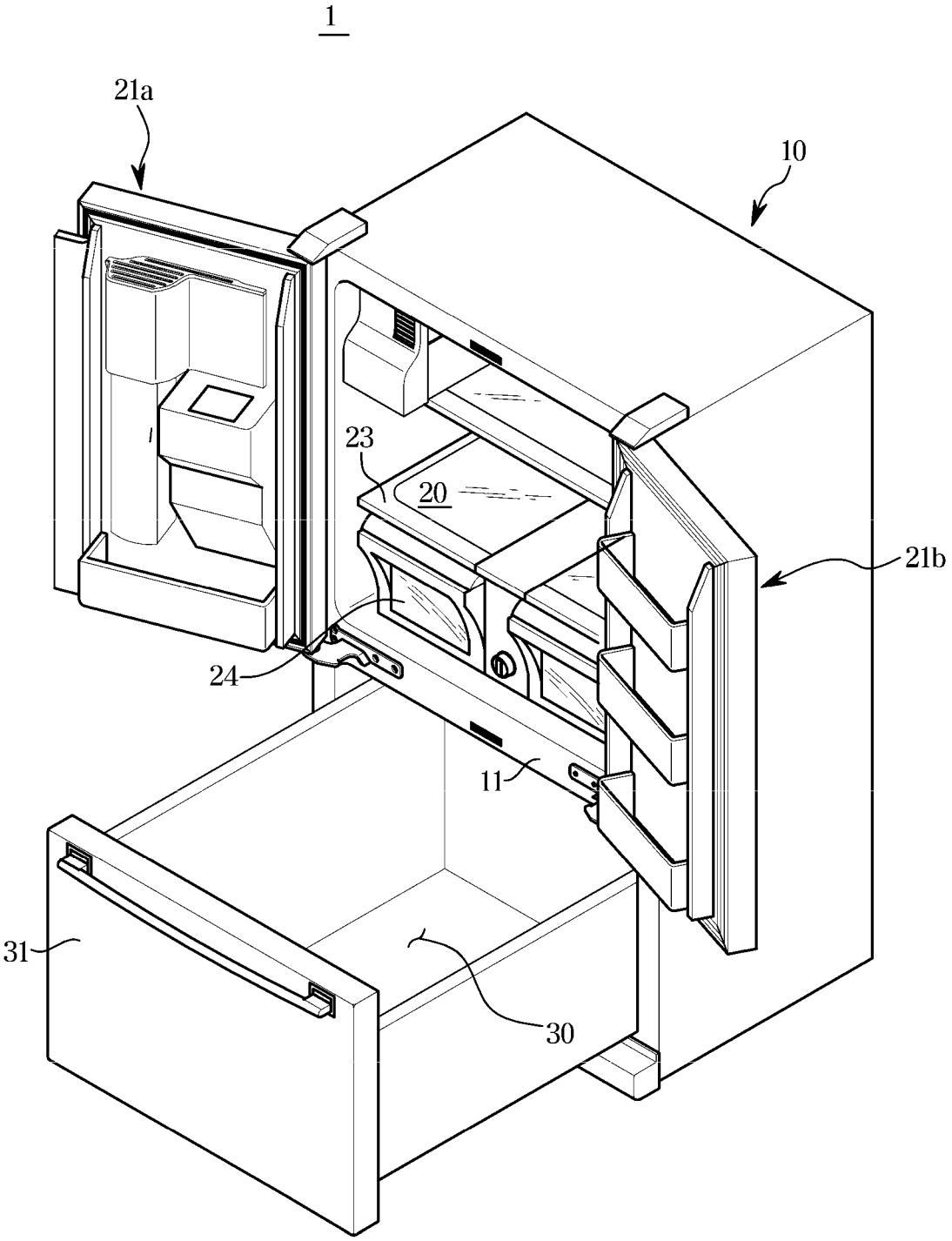
FIG. 1 is a view of an appearance of a refrigerator according to an embodiment of the disclosure.

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing operations described is an example; however, the sequence of and/or operations is not limited to that set forth herein and may be changed as is known in the art, with the exception of operations necessarily occurring in a particular order. In addition, respective descriptions of well-known functions and constructions may be omitted for increased clarity and conciseness.

Additionally, exemplary embodiments will now be described more fully hereinafter with reference to the accompanying drawings. The exemplary embodiments may, however, be embodied in many different forms and should not be construed as being limited to the embodiments set forth herein. These embodiments are provided so that this disclosure will be thorough and complete and will fully convey the exemplary embodiments to those of ordinary skill in the art. Like numerals denote like elements throughout.

It will be understood that, although the terms first, second, etc. may be used herein to describe various elements, these elements should not be limited by these terms. These terms are only used to distinguish one element from another. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present.

The terminology used herein is for the purpose of describing particular embodiments only and is not intended to be limiting. As used herein, the singular forms "a," "an," and "the," are intended to include the plural forms as well, unless the context clearly indicates otherwise.

Reference will now be made in detail to the exemplary embodiments of the present disclosure, examples of which are illustrated in the accompanying drawings, wherein like reference numerals refer to like elements throughout.

The expression, "at least one of a, b, and c," should be understood as including only a, only b, only c, both a and b, both a and c, both b and c, or all of a, b, and c.

Hereinafter a principle and embodiments of the disclosure will be described with reference to the accompanying drawings.

Figure 2:
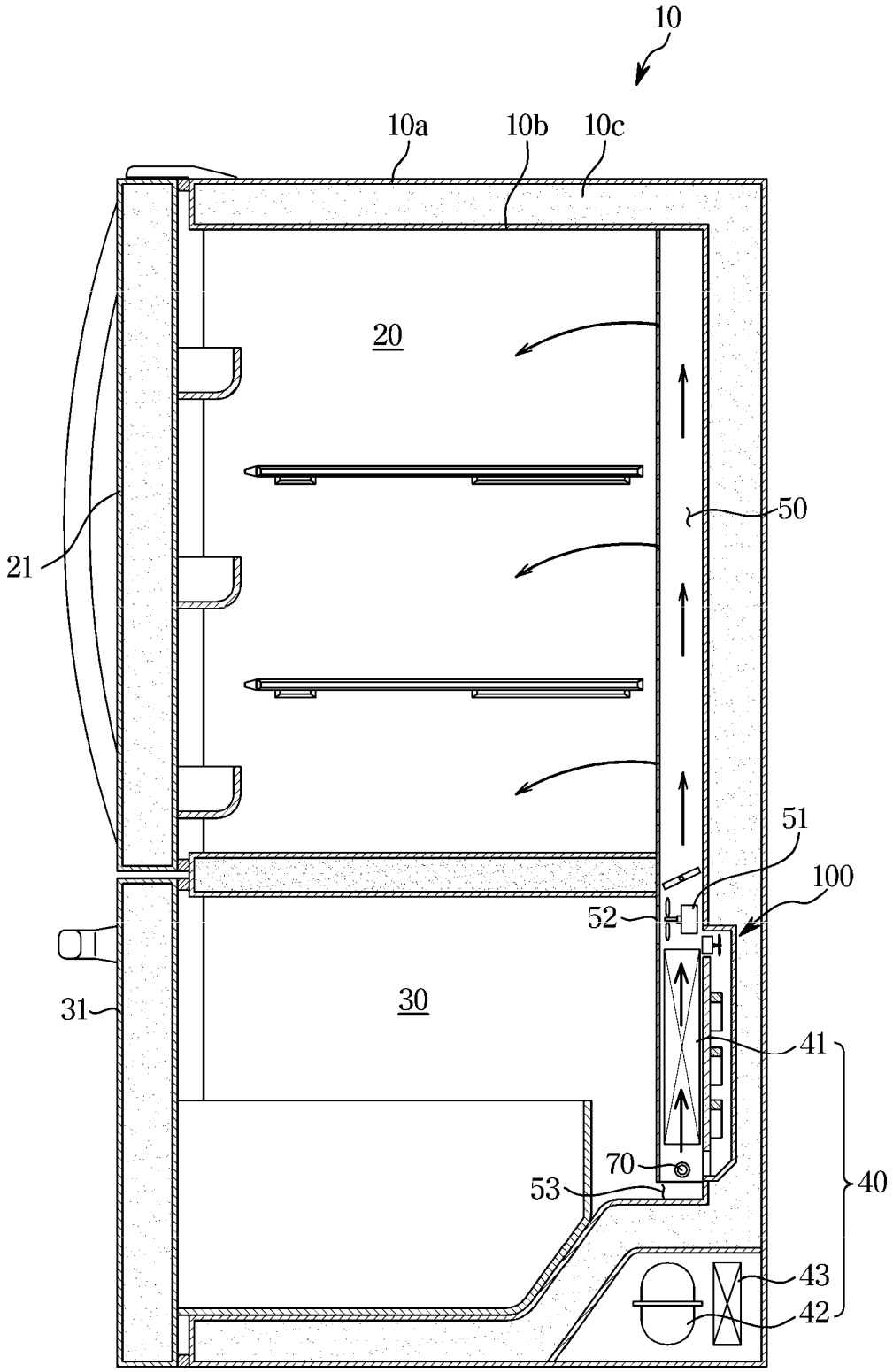
FIG. 2 is a cross-sectional view of the refrigerator according to an embodiment of the disclosure.
Figure 3:
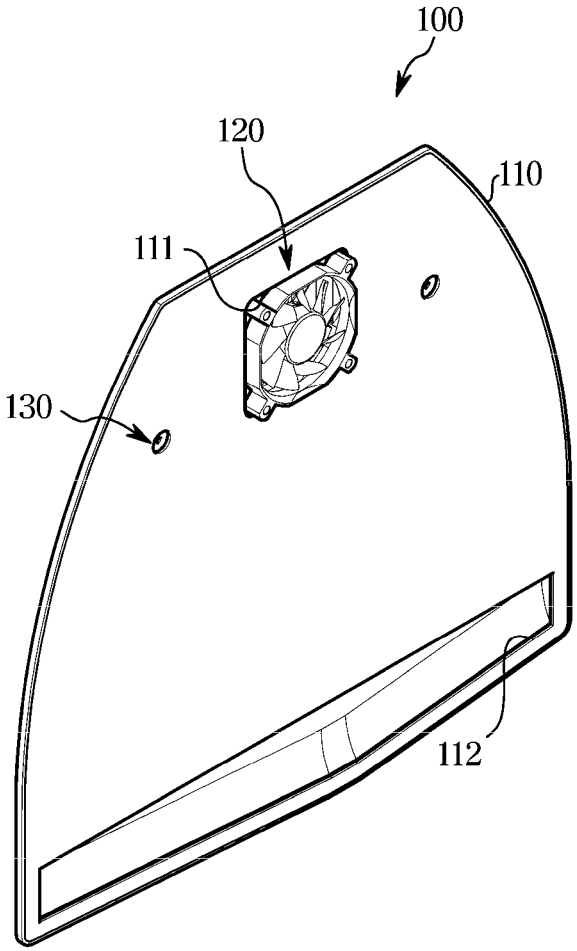
FIG. 3 is a view of an appearance of a defroster according to an embodiment of the disclosure.
Figure 4:
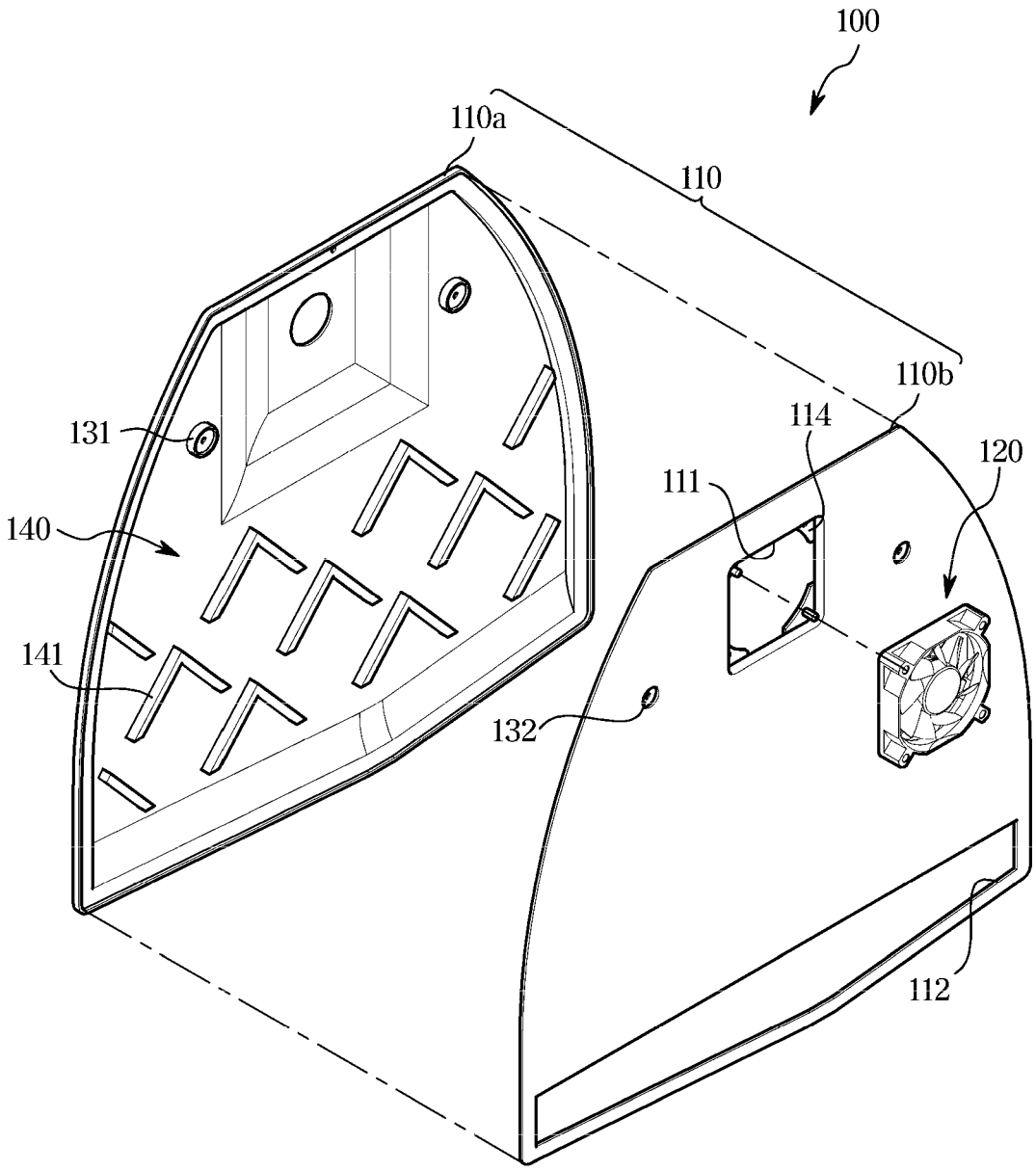
FIG. 4 is an exploded view of the defroster according to an embodiment of the disclosure.

FIG. 1 is a view of an appearance of a refrigerator according to an embodiment of the disclosure. FIG. 2 is a cross-sectional view of the refrigerator according to an embodiment of the disclosure. FIG. 3 is a view of an appearance of a defroster according to an embodiment of the disclosure. FIG. 4 is an exploded view of the defroster according to an embodiment of the disclosure.

As illustrated in FIGS. 1 to 4, a refrigerator 1 includes a body 10, a storage compartment (a freezing compartment 30 and a refrigerating compartment 20) formed in the body 10, and a cooler 40 configured to supply cold air to the storage compartments 20 and 30.

The body 10 includes an inner case 10*b* forming the storage compartments 20 and 30, an outer case 10*a* forming an appearance of the refrigerator 1 by being coupled to an outer side of the inner case 10*b*, and an insulating material 10*c* disposed between the inner case 10*b* and the outer case 10*a*.

The storage compartments 20 and 30 are partitioned into the upper refrigerating compartment 20 and the lower freezing compartment 30 by an intermediate partition 11. The refrigerating compartment 20 may be maintained at a temperature of approximately 3° C. to store food in the refrigerated state and the freezing compartment 30 may be maintained at a temperature of approximately −19° C. to store food in the frozen state. The refrigerating compartment 20 may be provided with a shelf 23 on which food is placed, and at least one storage box 24 configured to store food.

Each of the refrigerating compartment 20 and the freezing compartment 30 has a front face open to store food, and the open front face of the refrigerating compartment 20 may be opened and closed by a pair of doors 21*a* and 21*b* hinged to the body 10. The open front face of the freezing compartment 30 may be opened and closed by a drawer 31.

The cooler 40 may include an evaporator 41 in which a liquid refrigerant is evaporated, a compressor 42 configured to compress a gas refrigerant, a condenser 43 in which the gas refrigerant is condensed, and an expander configured to depressurize a liquid refrigerant.

The compressor 42 and the condenser 43 may be provided in a machine room provided at the rear lower side of the body 10.

The evaporator 41 is installed in a cooling duct 50 provided at the inner rear side of the storage compartments 20 and 30.

The cooling duct 50 is provided to allow air to flow in the inner rear side of the storage compartments 20 and 30. In the cooling duct 50, a blower fan 51 configured to discharge air, which is deprived of heat by the evaporator 41 (hereinafter referred to as cold air), into the storage compartments 20 and 30 and configured to suction air from the storage compartments 20 and 30 into the cooling duct 50 is installed.

An outlet port 52 may be formed above the cooling duct 50 so that the cold air generated by the evaporator 41 is discharged into the storage compartments 20 and 30. The outlet port 52 may be formed with a plurality of holes.

An inlet port 53 may be formed below the cooling duct 50 so that air in the storage compartments 20 and 30 is sucked into the cooling duct 50. The inlet port 53 may be formed with a plurality of holes.

Although it has been described that the evaporator 41 is provided at the rear of the storage compartments 20 and 30 and the cold air is moved from the lower side to the upper side, but is not limited thereto. For example, the evaporator may be arranged on a lower surface or an upper surface of the storage compartment to form a flow path in a corresponding direction.

The cooling duct 50 is provided with a first flow path P1 to allow cold air generated by the evaporator 41 to be supplied to the storage compartments 20 and 30 by the blower fan 51 during the cooling operation.

The first flow path P1 is configured to guide the air deprived of heat by the evaporator 41 to the storage compartments 20 and 30 during the cooling operation. The air deprived of heat by the evaporator 41 is moved from the lower side of the first flow path P1 to the upper side (hereinafter a first direction) by the blower fan 51. The air deprived of heat by the evaporator 41 is moved in the first direction A of the first flow path P1. For example, it has been described that the evaporator 41 is provided at the rear of the storage compartments 20 and 30 and the cold air is moved from the lower side to the upper side, but is not limited thereto. For example, the evaporator may be arranged on a lower surface or an upper surface of the storage compartment to form a flow path in a corresponding direction.

The refrigerator 1 includes a defroster 100 configure to defrost. The defroster 100 includes a defrost heater 70 configured to generate heat for defrosting.

The defrost heater 70 is provided below the evaporator 41 to remove frost formed on the evaporator 41.

The defrost heater 70 is configured to remove ice or frost generated in the evaporator 41 and an outlet port (not shown) provided in the cooling duct 50 so as to allow cold air to be smoothly discharged to the storage compartments 20 and 30.

The defrost heater 70 may include at least one of a sheath heater, a cord heater, a hot gas of the cycle itself, and a heat pump cycle.

Air heated by the defrost heater 70 is moved upward by convection.

Although it has been described that the cooling duct 50 and the first flow path P1 are provided in the up-down direction, the air heated by the defrost heater 70 may be moved to the upper side from the lower side (first direction) as an example, but is not limited thereto. For example, the cooling duct and the evaporator may be arranged on the lower surface or the upper surface of the storage compartment. In addition, although the defrost heater has been illustrated to be arranged below the evaporator, as an example, but is not limited thereto. For example, the defrost heater may be located in the upper side or the lateral side of the evaporator.

The defroster 100 may be arranged around the evaporator 41. The defroster 100 may be arranged behind the evaporator 41. The defroster 100 may be installed in the inner case 10*b* of the body 10. The defroster 100 may be arranged between the inner case 10*b* and the outer case 10*a* of the body 10. The defroster 100 may be fixed to the inner case 10*b* of the body 10 by a fastening member such as a bolt. The defroster 100 may be pressed and fixed into the inner case 10*b*.

The defroster 100 includes a defrost case 110 and a defrost fan 120 installed in the defrost case 110.

Air receiving heat from the defrost heater 70 is moved in the first direction A of the first flow path P1 by convection, and the defroster 100 is configured to move air, which receives heat from the defrost heater 70 while passing through the first flow path P1, to a second flow path P2.

The second flow path P2 is provided to allow air, which receives heat from the defrost heater 70, to be circulated around the evaporator 41 in the defrosting operation.

The defrost fan 120 may be installed so that the air receiving heat from the defrost heater 70 may be circulated to the second flow path P2. The defrost fan 120 is configured to move air, which passed through the first flow path P1, to flow into the second flow path P2. The defrost fan 120 may be driven to be rotated in a direction opposite to the blower fan 51.

The defrost case 110 includes a first case 110*a* and a second case 110*b*. The first case 110*a* and the second case 110*b* may be coupled by a case coupler 130. A first case coupler 131 is provided in the first case 110*a*, and a second case coupler 132 is provided in the second case 110*b*. The second case coupler 132 may be provided at a position corresponding to the first case coupler 131. The first case coupler 131 and the second case coupler 132 may be assembled by a member such as a bolt or a hook.

The second flow path P2 may be formed between the first case 110*a* and the second case 110*b*. The first case 110*a* may be coupled to the inner case 10*b* of the body 10. The defrost case 110 is described to be press-fitted into and fixed to at least a portion of the inner case 10*b* of the body 10 as an example, but is not limited thereto. For example, the defrost case may be fixed to the inner case, in which at least a part is opened, by a fastening member such as a bolt. At this time, at least one side of the defrost case may be fixed by the insulating material 10*c*.

The defrost case 110 includes an inlet 111 through which the air, which receives heat from the defrost heater 70 and is passed the evaporator 40, is suctioned to the second flow path P2, and an outlet 112 through which air, which passed the second flow path P2, is discharged to the defrost heater 70.

The inlet 111 and the outlet 112 may be formed in the second case 110*b*. The inlet 111 may be formed at an upper portion of the second case 110*b* and the outlet 112 may be formed at the lower portion of the second case 110*b*. For example, the inlet and the outlet are described to be provided in the second case 110*b*, but is not limited thereto.

The defrost fan 120 may be installed in at least one of the first case 110*a* and the second case 110*b*. The defrost case 110 includes a fan installation 114 for installing the defrost fan 120. The fan installation 114 may be formed around the inlet 111 of the defrost case 110 to guide air, which is introduced through the inlet 111 of the defrost case 110, to the second flow path P2. The fan installation 114 is arranged at the upper portion of the defrost case 110. The fan installation 114 may be arranged at the upper center of the second case 110*b*. The fan installation 114 may be formed at a position corresponding to the inlet 111. The fan installation 114 may include the inlet 111.

The air receiving heat from the defrost heater 70 may be passed along the first flow path P1 and then introduced into the inlet 111 of the defrost case 110 by the defrost fan 120 and then guided to the second flow path P2. In addition, the air introduced into the inlet 111 is guided in a second direction B of the second flow path P2 and discharged to the lower portion of the cooling duct 50 through the outlet 112.

The air discharged to the outlet 112 of the second flow path P2 is moved toward the defrost heater 70 again to receive heat by the defrost heater 70, and the heated air is moved to the evaporator 40 again. As a result, the heat from the defrost heater 70 may be circulated without leakage.

On the other hand, the second flow path P2 includes a flow path resistance portion 140 configured to prevent the air, which receives heat from the defrost heater 70, from being bypassed during the cooling operation.

The flow path resistance portion 140 may be formed at an inner lower portion of the second flow path P2. The flow path resistance portion 140 is configured to form an asymmetric flow resistance inside the second flow path P2. The flow path resistance portion 140 may be formed in such a way that a resistance in the upward direction is large and a resistance in the downward direction is small because the air flows from the lower side to the upper side during the cooling operation.

The flow path resistance portion 140 includes a plurality of flow path resistance members 141.

The plurality of flow path resistance members 141 is configured to reduce the flow resistance in the downward direction and increase the flow resistance in the upward direction of the second flow path P2.

The flow path resistance member 141 may be implemented in an up-down asymmetric shape in the plane of the second flow path P2. For example, the flow path resistance member 141 may be formed in a triangular shape and arranged in the second flow path P2.

The flow path resistance member 141 may be arranged at least one row in the lower portion of the second flow path P2. The plurality of flow path resistance members 141 may be arranged in a zigzag pattern.

The flow path resistance member 141 may be disposed in at least one of the first case 110*a* and the second case 110*b*. The flow path resistance member 141 may be injection molded integrally with the defrost case 110. For example, the flow path resistance member 141 may be injection molded integrally with the first case 110*a*. Alternatively, the flow path resistance member 141 may be injection molded integrally with the second case 110*b*.

Figure 5:
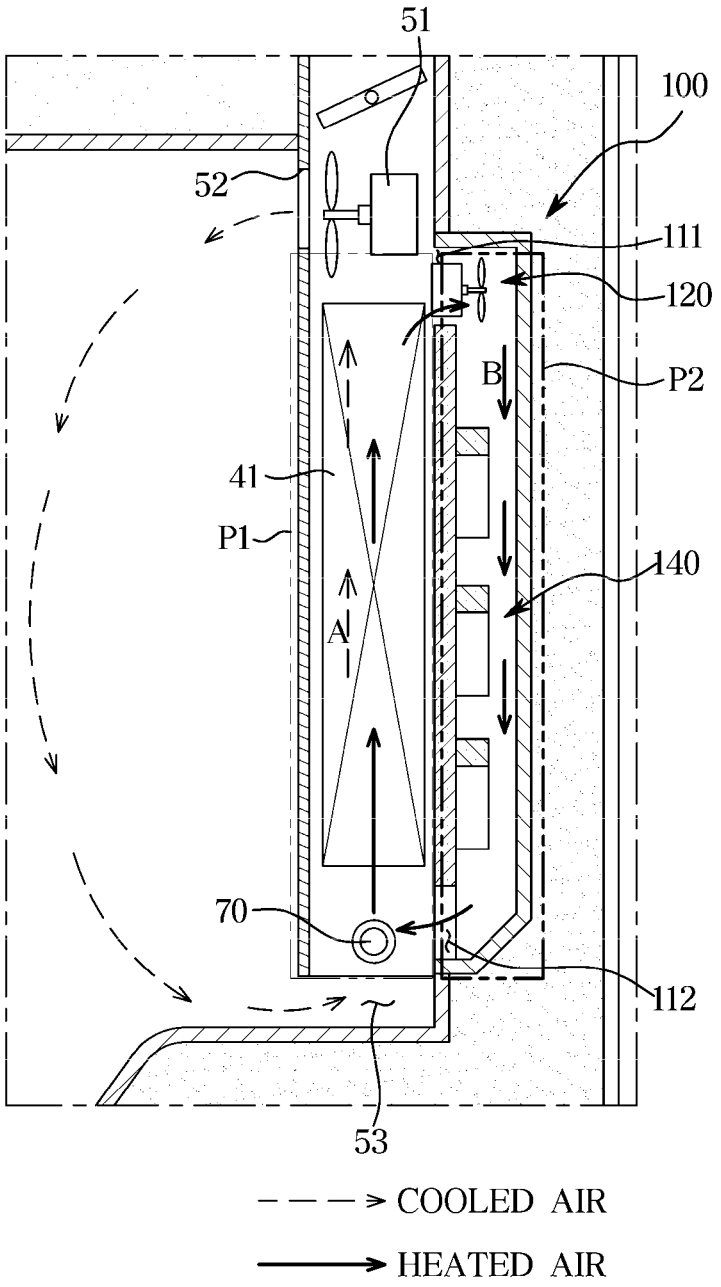
FIG. 5 is a view illustrating an example of an air flow by the defroster according to an embodiment of the disclosure.

FIG. 5 is a view illustrating an example of an air flow by the defroster according to an embodiment of the disclosure.

In the cooling operation of the refrigerator 1, the blower fan 51 may be operated and the defrost fan 120 may be stopped.

Air in the storage compartments 20 and 30 may be introduced into the cooling duct 50 by the blower fan 51. The evaporator 41 may cool the air through heat exchange of the refrigerant, and the air cooled by the evaporator 41 may be moved in the first direction A by the blower fan 51 provided above the evaporator 41 and then discharged to the storage compartments 20 and 30.

At this time, because the flow path resistance portion 140 of the defroster 100 increases the flow resistance in the upward direction, the flow path resistance portion 140 prevents the air, which is suctioned from the storage compartments 20 and 30, from being bypassed to the second flow path P2.

During the defrosting operation of the refrigerator 1, the defrost heater 70 of the defroster 100 is operated. In addition, the blower fan 51 may be stopped, and the defrost fan 120 may be operated.

Hot air heated by the defrost heater 70 is raised by convection. The air receiving heat from the defrost heater 70 removes the frost formed on the evaporator 41 and is sucked into the second flow path P2 by the defrost fan 120 from the first flow path P1.

In this case, during the defrosting operation, a rotation direction of the defrost fan 120 may be opposite to a rotation direction of the blower fan 51.

The air, which receives heat from the defrost heater 70 and is introduced into the second flow path P2 by the defrost fan 120, is moved in the second direction B and discharged through the outlet 112. The air discharged through the outlet 112 is heated by the defrost heater 70 again and moved to the evaporator 41, thereby being circulated.

At this time, by reducing the flow resistance in the downward direction, the flow path resistance portion 140 provided in the second flow path P2 facilitates the flow of the heated air, which receives heat from the defrost heater 70, during the defrosting operation.

On the contrary, by increasing the flow resistance in the upward direction, the flow path resistance portion 140 provided in the second flow path P2 minimizes the loss of cold air that is caused by the bypass by the second flow path P2 during the cooling operation.

Therefore, the flow path resistance portion 140 of the defroster 100 increases the flow resistance of the cold air of the second flow path P2 during the cooling operation and reduces the flow resistance of the heated air during the defrosting operation, and thus it is possible to minimize the loss of cold air caused by the bypass of the cold air toward the second flow path P2 during the cooling operation. Therefore, the flow path resistance portion 140 may reduce a defrost time by the heated air circulation, and it is possible to improve the defrost energy.

Figure 6:
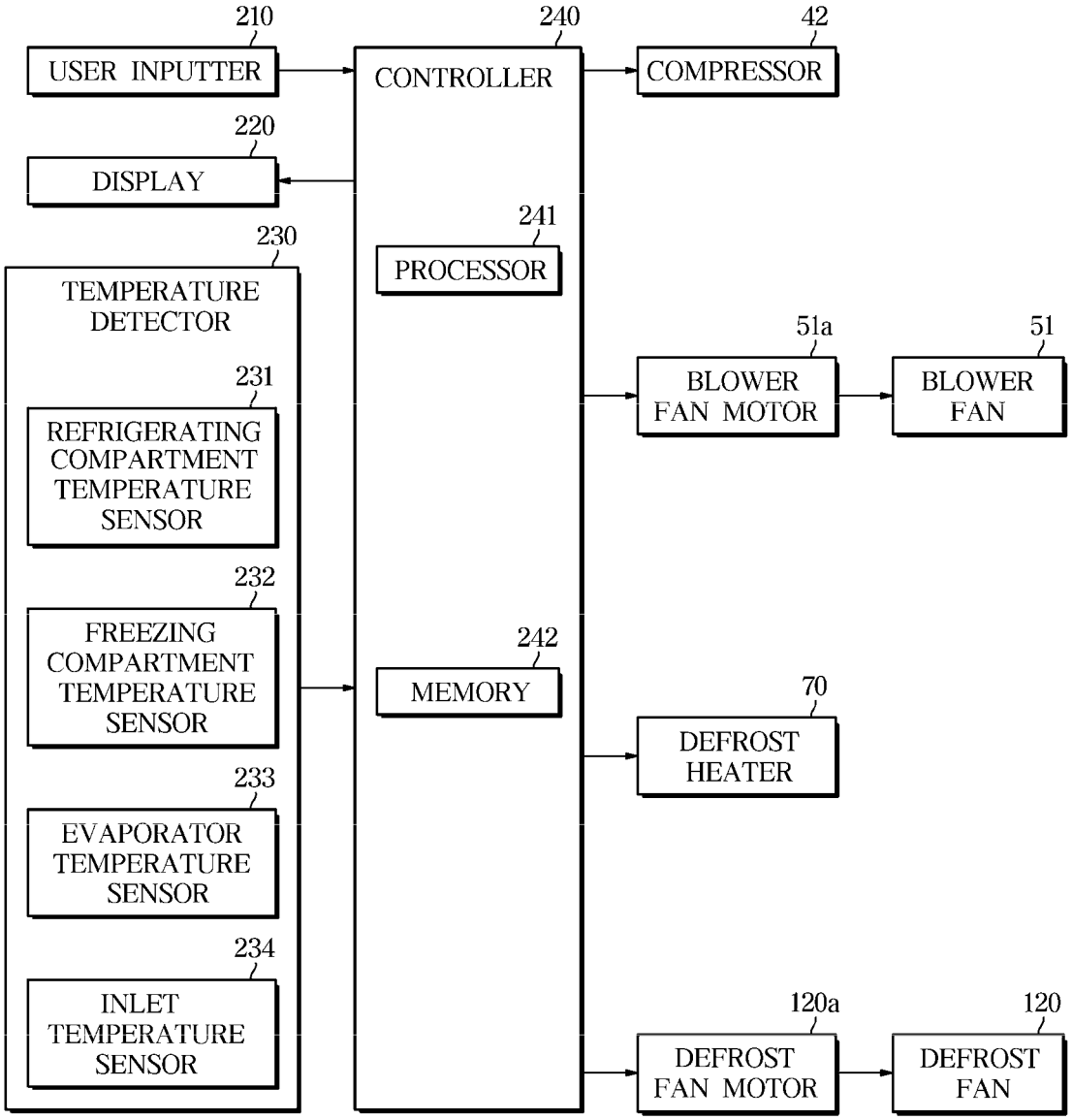
FIG. 6 is a diagram illustrating an electrical configuration of the refrigerator according to an embodiment of the disclosure.

FIG. 6 is a diagram illustrating an electrical configuration of the refrigerator according to an embodiment of the disclosure.

As illustrated in FIG. 6, the refrigerator 1 includes a user inputter 210, a display 220, a temperature detector 230, the compressor 42, the blower fan 51, a blower fan motor 51*a*, the defrost heater 70, the defrost fan 120, a defrost fan motor 120*a*, and a controller 240.

The user inputter 210 and the display 220 for controlling the refrigerator 1 may be arranged in the doors 21 including doors 21*a* and 21*b* of the refrigerator 1.

The user inputter 210 may receive a user input related to the operation of the refrigerator 1 from the user, and output an electrical signal (voltage or current) corresponding to the received user input to the controller 240.

The user inputter 210 may include buttons configured to receive a user input related to the operation of the refrigerator 1. For example, the user inputter 210 may include a button for setting a temperature of the refrigerating compartment 20 and a button for setting a temperature of the freezing compartment 30. The button may include a push switch and a membrane switch actuated by the user's pressing, or a touch switch actuated by the contact of a part of the user's body.

The display 220 may receive information related to the operation of the refrigerator 1 from the controller 240 and display an image corresponding to the received information.

The display 220 may convert an electrical signal into an optical signal. For example, the display 220 may include a light emitting diode (LED) panel, an organic light emitting diode (OLED) panel, or a liquid crystal display (LCD) panel.

The display 220 may include a touch screen panel (TSP) configured to receive a touch input from a user and display operation information corresponding to the touch input. The touch screen panel may identify a user input based on a touch input detected through the touch panel and an image displayed through the display.

The temperature detector 230 includes a refrigerating compartment temperature sensor 231, a freezing compartment temperature sensor 232, an evaporator temperature sensor 233, and an inlet temperature sensor 234.

The freezing compartment temperature sensor 232 may measure the temperature inside the freezing compartment 30. For example, the freezing compartment temperature sensor 232 may be installed near the outlet port 52 through which the cold air is discharged from the cooling duct 50 to the freezing compartment 30, and measure the temperature of the air discharged to the freezing compartment 30. Alternatively, the freezing compartment temperature sensor 232 may be installed at the inner upper portion of the freezing compartment 30, and measure the temperature of the inner upper portion of the freezing compartment 30.

The freezing compartment temperature sensor 232 may output an electrical signal (voltage or current) corresponding to the temperature inside the freezing compartment 30 to the controller 240. For example, the freezing compartment temperature sensor 232 may include a thermistor in which an electrical resistance value changes with temperature.

The refrigerating compartment temperature sensor 231 may measure a temperature inside the refrigerating compartment 20. For example, the refrigerating compartment temperature sensor 231 may be installed near the outlet port through which the cold air is discharged from the cooling duct 50 to the refrigerating compartment 20, and measure the temperature of the air discharged to the refrigerating compartment 20. Alternatively, the refrigerating compartment temperature sensor 231 may be installed at the inner upper portion of the refrigerating compartment 20, and measure the temperature of the inner upper portion of the refrigerating compartment 20.

The refrigerating compartment temperature sensor 231 may output an electrical signal (voltage or current) corresponding to the temperature of the refrigerator 1 to the controller 240. For example, the refrigerating compartment temperature sensor 231 may include a thermistor.

The evaporator temperature sensor 233 may measure the temperature of the evaporator 41. For example, the evaporator temperature sensor 233 may be installed in the upper side of the evaporator 41, and may measure the temperature of the upper side of the evaporator 41.

The evaporator temperature sensor 233 may output an electrical signal (voltage or current) corresponding to the temperature of the evaporator 41 to the controller 240. For example, the evaporator temperature sensor 233 may include a thermistor.

The inlet temperature sensor 234 may be installed near the inlet port 53 configured to suction air from the freezing compartment 30 into the cooling duct 50, and may measure the temperature of the ambient air of the inlet port 53.

The inlet temperature sensor 234 may output an electrical signal (voltage or current) corresponding to the temperature of the air around the inlet port 53 to the controller 240. For example, inlet temperature sensor 234 may include a thermistor.

The compressor 42 may compress the gaseous refrigerant in response to the control signal of the controller 240. The compressor 42 may be a part of the cooler 40.

The cooler 40 includes the compressor 42 described above, the condenser 43 configured to convert a compressed gaseous refrigerant into the liquid state, the expander configured to depressurize the liquid refrigerant, and the evaporator 41 configured to convert the depressurized liquid refrigerant into the gaseous state.

While circulating through the compressor 42, the condenser 43, the expander and the evaporator 41, the refrigerant may absorb thermal energy from the storage compartments 20 and 30, and discharge the absorbed thermal energy to the outside of the refrigerator 1. Particularly, the refrigerant may absorb thermal energy while being evaporated in the evaporator 41 and the refrigerant may discharge thermal energy while being condensed in the condenser 43.

As the refrigerant absorbs thermal energy in the evaporator 41, the air in the cooling duct 50 is cooled. The blower fan 51 may supply air, which is deprived of heat by the evaporator 41, to the storage compartments 20 and 30.

For example, the blower fan 51 may be arranged above the evaporator 41 or in the vicinity of the outlet port 52, and may discharge the air, which is deprived of heat by the evaporator 41, to the storage compartments 20 and 30.

The blower fan motor **51*a* may rotate the blower fan 51 in response to a control signal of the controller 240. In addition, the blower fan motor 51*a* may change a rotational speed of the blower fan 51 in response to the control signal of the controller 240**.

The defrost heater 70 may generate heat in response to a control signal of the controller 240. For example, the defrost heater 70 may be installed below the evaporator 41 and generate heat for removing frost formed on the evaporator 41.

The defrost heater 70 may heat the air of the cooling duct 50. The defrost fan 120 may suction air heated by the defrost heater 70 into the defroster 100.

For example, the defrost fan 120 may be arranged near the inlet 111 of the defroster 100, and suction the air, which is heated by the defrost heater 70 and passed through the evaporator 41, toward the defroster 100.

The defrost fan motor **120*a* may rotate the defrost fan 120 in response to a control signal of the controller 240. In addition, the defrost fan motor 120*a* may change the rotational speed of the defrost fan 120 in response to a control signal of the controller 240**.

The controller 240 may include a processor 241 configured to generate a control signal for controlling the operation of the refrigerator 1 and a memory 242 configure to store and/or memorize a program and data for generating the control signal.

Based on the program and data stored and/or stored in the memory 242, the processor 241 may process the user input received through the user inputter 210 and the temperature information measured by the temperature sensor 230. The processor 241 may generate a control signal for controlling the compressor 42, the blower fan motor **51*a*, the defrost heater 70, and the defrost fan motor 120*a*** based on the user input and the temperature information.

The processor 241 may set a target temperature of the refrigerating compartment 20 and the freezing compartment 30 based on a user input. For example, the processor 241 may set the target temperature of the refrigerating compartment 20 to approximately 3° C. and set the target temperature of the freezing compartment 30 to approximately −19° C. based on a user input.

The processor 241 may generate a cooling control signal for controlling the operation of the compressor 42 and the blower fan motor 51*a* based on the target temperature and the temperature information. For example, the processor 241 may operate the compressor 42 and the blower fan motor 51*a* in response to the measured temperature of the freezing compartment 30 being greater than or equal to −18° C. Further, the processor 241 may stop the compressor 42 and the blower fan motor 51*a* in response to the measured temperature of the freezing compartment 30 being less than or equal to −20° C.

Based on an operation time of the compressor 42 during the operation of the compressor 4, the processor 241 may generate a defrost control signal for controlling an operation of the compressor 42, the blower fan motor 51*a*, the defrost heater 70, and the defrost fan motor 120*a*. For example, in response to an operation time of the compressor 42 being greater than or equal to a predetermined time, the processor 241 may stop the compressor 42 and the blower fan motor 51*a* and operate the defrost heater 70 and the defrost fan motor 120*a*.

Based on the temperature of the evaporator 41 during the operation of the defrost heater 70, the processor 241 may generate a defrost control signal for controlling an operation of the compressor 42, the blower fan motor 51*a*, the defrost heater 70, and the defrost fan motor 120*a*. For example, in response to the temperature of the evaporator 41 being greater than or equal to a predetermined temperature, the processor 241 may stop the defrost heater 70 and the defrost fan motor 120*a*, and operate the compressor 42 and the blower fan motor 51*a*.

The processor 241 may delay the operation of the defrost fan motor 120*a* based on the temperature of the evaporator 41 at the start of operation.

When the operation of the defrost heater 70 is terminated, the processor 241 may delay the operation of the blower fan motor 51*a* and extend the operation of the defrost fan motor 120*a*.

The processor 241 may control the rotational speed of the defrost fan motor 120*a* based on the temperature of the inlet port 53 and the temperature of the storage compartments 20 and 30 during the operation of the defrost heater 70.

The processor 241 may include an operation circuit, a memory circuit, and a control circuit. The processor 241 may include one chip or may include a plurality of chips. In addition, the processor 241 may include one core or may include a plurality of cores.

The memory 242 may store programs and data for controlling the compressor 42 and the blower fan motor 51*a* during the cooling operation of the refrigerator 1, and store programs and data for controlling the defrost heater 70 and the defrost fan motor 120*a* during the defrosting operation of the refrigerator 1.

The memory 242 may temporarily store the user input, which is input through the user inputter 210, and temperature information detected by the temperature sensor 230, and temporarily store the cooling control signal and the defrost control signal of the processor 241.

The memory 242 may include volatile memory such as static random access memory (S-RAM) and dynamic random access memory (D-RAM), and non-volatile memory such as read only memory, erasable programmable memory (EPROM), or electrically erasable programmable read only memory (EEPROM).

The memory 242 may include one memory element or may include a plurality of memory elements.

Figure 7:
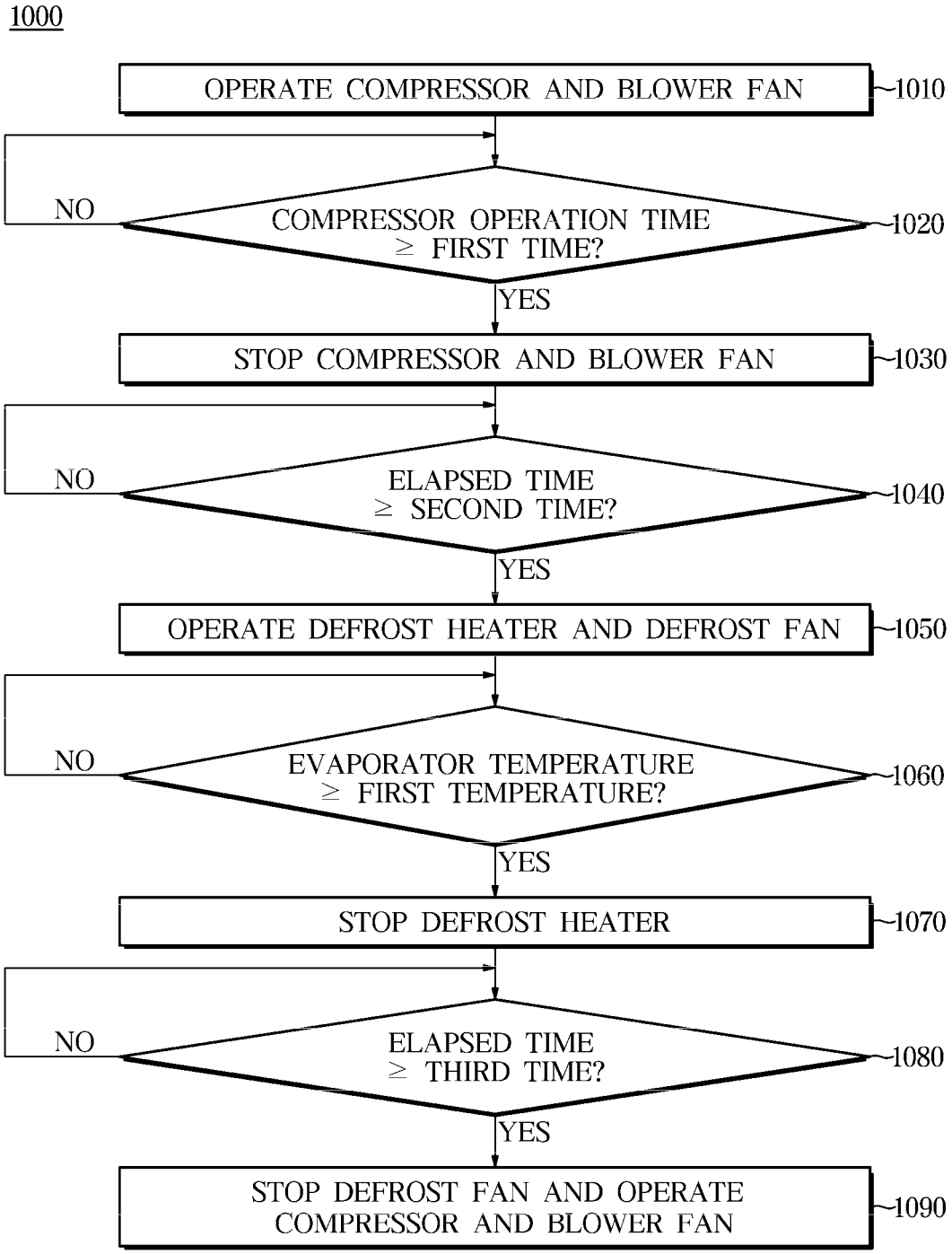
FIG. 7 is a view illustrating an example of cooling/defrosting operations of the refrigerator according to an embodiment of the disclosure.
Figure 8:
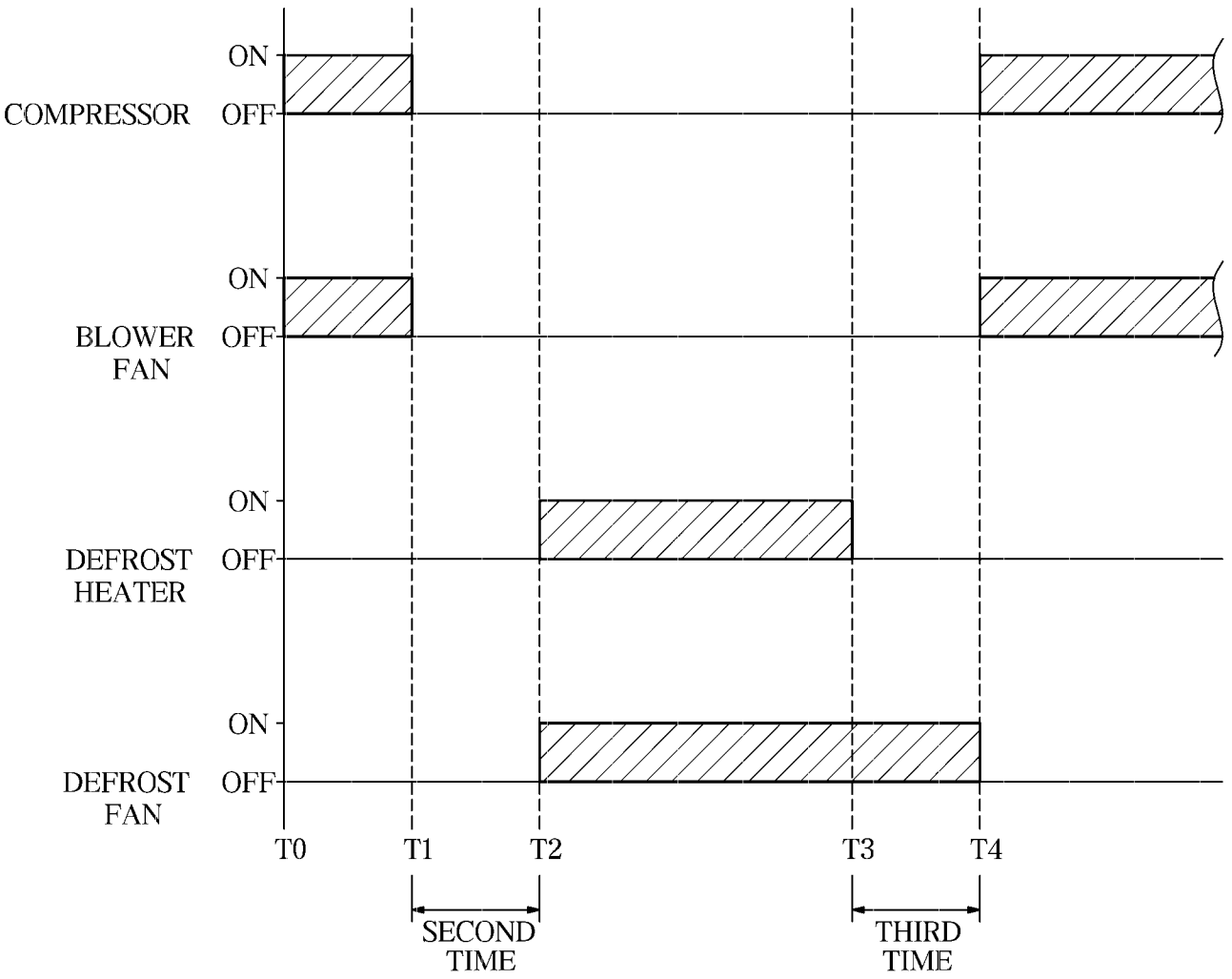
FIG. 8 is a view illustrating an operation of a compressor, a blower fan, a defrost heater, and a defrost fan according to the cooling/defrosting operations of FIG. 7.

FIG. 7 is a view illustrating an example of cooling/defrosting operations of the refrigerator according to an embodiment of the disclosure. FIG. 8 is a view illustrating an operation of a compressor, a blower fan, a defrost heater, and a defrost fan according to the cooling/defrosting operations of FIG. 7.

A cooling/defrosting operation (1000) of the refrigerator 1 will be described with reference to FIGS. 7 and 8.

The refrigerator 1 operates the compressor 42 and the blower fan 51 (1010). The refrigerator 1 performs the cooling operation.

The controller 240 may operate the compressor 42 and the blower fan 51 based on the target temperature of the storage compartments 20 and 30 and the measured temperature of the storage compartments 20 and 30. For example, the processor 241 may operate the compressor 42 and the blower fan 51 in response to the measured temperature of the freezing compartment 30 being greater than or equal to −18° C.

Due to the operation of the compressor 42, the refrigerant may be circulated through the compressor 42, the condenser 43, the expander and the evaporator 41. Particularly, as the refrigerant is condensed in the condenser 43, the condenser 43 may release the thermal energy to the ambient air, and then heat the ambient air. As the refrigerant is evaporated in the evaporator 41, the evaporator 41 may absorb heat from the ambient air and cool the air of the first flow path P1.

Due to the operation of the blower fan 51, the air of the first flow path P1 cooled by the evaporator 41 may be discharged to the storage compartments 20 and 30.

As illustrated in FIG. 8, the controller 240 may operate the compressor 42 and the blower fan 51 at a time T0.

In addition, frost is formed on the evaporator 41 due to condensation of water vapor contained in the ambient air while the evaporator 41 cools the ambient air.

The refrigerator 1 identifies whether an operation time of the compressor 42 is greater than or equal to a first time (1020).

While the compressor 42 is operated, the controller 240 may calculate an operation time in which the compressor 42 is operated. For example, the controller 240 may calculate a first operation time indicating a total operation time of operating the compressor 42 after the defrost of the evaporator 41, and calculate a second operation time indicating a continuous operation time in which the compressor 42 is continuously operated.

The controller 240 may compare the operation time (the first operation time or the second operation time) of the compressor 42 with the first time.

The first time may be set through experiment or experience. For example, the first time may be set based on the operation time of the compressor 42 in which the heat exchange efficiency of the evaporator 41 is lowered due to frost on the evaporator 41. In addition, the first time compared to the first operation time may be different from the first time compared to the second operation time.

Alternatively, the controller 240 may calculate the number of times in which the doors 21; 21*a* and 21*b* are opened while the compressor 42 is operated. In addition, the controller 240 may compare a reference number with the number of times in which the doors 21; 21*a* and 21*b* are opened.

When the operation time of the compressor 42 is not greater than or equal to the first time (no in 1020), the refrigerator 1 continues the cooling operation.

When the operation time of the compressor 42 is greater than or equal to the first time (yes in 1020), the refrigerator stops the compressor and the blower fan 51 (1030). The refrigerator 1 terminates the cooling operation and starts the defrosting operation.

When the operation time of the compressor 42 is greater than or equal to the first time, it may be identified that the heat exchange of the evaporator 41 is deteriorated due to frost formed on the evaporator 41. The controller 240 may stop the compressor 42 and the blower fan 51 in response to the operation time of the compressor 42 being greater than or equal to the first time. For example, the controller 240 may stop the compressor and the blower fan motor 51*a* in response to the total operation time (the first operation time) of the compressor 42 being greater than or equal to the first time. Alternatively, the controller 240 may stop the compressor and the blower fan motor 51*a* in response to the continuous operation time (the second operation time) of the compressor 42 being greater than or equal to the first time.

As illustrated in FIG. 8, the controller 240 may stop the compressor 42 and the blower fan 51 at a time T1 in which the operation time of the compressor 42 is greater than or equal to the first time.

The refrigerator 1 identifies whether a time elapsed since the compressor 42 is stopped is greater than or equal to a second time (1040).

The controller 240 may count the time elapsed since the compressor 42 is stopped. The controller 240 may compare the elapsed time with the second time.

The second time may be set through experiment or experience. For example, the second time may be set based on a period of time until all the remaining refrigerant in the evaporator 41 is evaporated and stabilized from when the compressor 42 is stopped.

The second time may be varied. The second time may be varied based on the temperature of the storage compartments 20 and 30. For example, as the temperature of the freezing compartment 30 at the start of defrosting operation is higher, the second time may be shorter, and as the temperature of the freezing compartment 30 at the start of defrosting operation is lowered, the second time may be longer.

When the time elapsed since the compressor 42 is stopped is not greater than or equal to the second time (no in 1040), the refrigerator 1 waits.

When the time elapsed since the compressor 42 is stopped is greater than or equal to the second time (yes in 1040), the refrigerator 1 operates the defrost heater 70 and the defrost fan 120 (1050).

When it is identified that all the remaining refrigerant in the evaporator 41 is evaporated and stabilized after the compressor 42 is stopped, the controller 240 may operate the defrost heater 70 and the defrost fan 120.

The controller 240 may operate the defrost heater 70 and the defrost fan 120 in response to the elapse of the second time from the stop of the compressor 42. As illustrated in FIG. 8, the controller 240 may operate the defrost heater 70 and the defrost fan 120 at a time T2 in which the second time is elapsed since the compressor 42 is stopped.

The controller 240 may remove frost formed on the evaporator 41 by operating the defrost heater 70. The defrost heater 70 provided below the evaporator 41 may heat the ambient air, and the air heated by the defrost heater 70 may be raised to transfer heat to the frost formed on the evaporator 41. Accordingly, due to the operation of the defrost heater 70, the air in the first flow path P1 is raised.

The controller 240 may prevent the air heated by the defrost heater 70 from leaking into the storage compartments 20 and 30 by operating the defrost fan 120. Air raised in the first flow path P1 due to the operation of the defrost heater 70 may flow into the storage compartments 20 and 30 through the outlet port 52. To prevent this, the defrost fan 120 may suction the air, which is raised by the operation of the defrost heater 70, into the second flow path P2 of the defroster 100 through the inlet 111. Further, the defrost fan 120 may discharge the air passed through the second flow path P2 to the vicinity of the defrost heater 70 through the outlet 112.

Due to the operation of the defrost fan 120, it is possible to minimize an increase in the temperature of the storage compartments 20 and 30 during the defrosting operation of the refrigerator 1.

The refrigerator 1 identifies whether a temperature of the evaporator 41 is greater than or equal to a first temperature (1060).

During the defrosting operation of the refrigerator 1, the frost formed on the evaporator 41 is melted by the operation of the defrost heater 70, and thus the temperature of the evaporator 41 may increase.

During the defrosting operation of the refrigerator 1, the controller 240 may receive a signal related to the temperature of the evaporator 41 from the evaporator temperature sensor 233, and identify the temperature of the evaporator 41 based on the received signal. The controller 240 may compare the temperature of the evaporator 41 with the first temperature.

The first temperature may be set through experiment or experience. For example, the first temperature may be set to a temperature at which it is identified that all of the frost formed on the evaporator 41 is removed. For example, the first temperature may be set to approximately 5° C.

When the temperature of the evaporator 41 is not greater than or equal to the first temperature (no in 1060), the refrigerator 1 continues the defrosting operation.

When the temperature of the evaporator 41 is greater than or equal to the first temperature (yes in 1060), the refrigerator 1 stops the defrost heater 70 (1070).

When the temperature of the evaporator 41 is greater than or equal to the first temperature, it may be identified that most of the frost formed on the evaporator 41 is removed.

The controller 240 may stop the defrost heater 70 in response to the temperature of the evaporator 41 being greater than or equal to the first temperature. As illustrated in FIG. 8, the controller 240 may stop the defrost heater 70 at a time T3 in which the temperature of the evaporator 41 reaches the first temperature.

After the defrost heater 70 is stopped, heat is still released in the defrost heater 70 for a predetermined time. The controller 240 may continue to operate the defrost fan 120 until all the heat of the defrost heater 70 is exhausted.

The refrigerator 1 identifies whether a time elapsed since the defrost heater 70 is stopped is greater than or equal to a third time (1080).

The controller 240 may count the time elapsed since the defrost heater 70 is stopped. The controller 240 may compare the elapsed time with the third time.

The third time may be set through experiment or experience. For example, the third time may be set based on a time from when the defrost heater 70 is stopped until the temperature of the defrost heater 70 reaches a target room temperature.

The third time may be varied. The third time may be extended based on the temperature of the evaporator 41. For example, when a temperature value of the evaporator 41, which is raised after the stop of the defrost heater 70, is greater than or equal to a predetermined value, the controller 240 may delay the operation of the compressor 42 after the third time is elapsed.

When a time elapsed since the defrost heater 70 is stopped is not greater than or equal to the third time (no in 1080), the refrigerator 1 waits.

When the time elapsed since the defrost heater 70 is stopped is greater than or equal to the third time (yes in 1080), the refrigerator 1 stops the defrost fan 120 and operates the compressor 42 and the blower fan 51 (1090). The refrigerator 1 terminates the defrosting operation and starts the cooling operation.

When it is identified that all the heat of the defrost heater 70 is exhausted after the defrost heater 70 is stopped, the controller 240 may stop the defrost fan 120. In addition, the controller 240 may operate the compressor 42 and the blower fan 51. The controller 240 may stop the defrost fan 120 and operate the compressor 42 and the blower fan 51 in response to the elapse of the third time from the stop of the defrost heater 70. As illustrated in FIG. 8, the controller 240 may stop the defrost fan 120 and operate the compressor 42 and the blower fan 51 at a time T4 in which the third time is elapsed since the defrost heater 70 is stopped.

Due to the operation of the compressor 42, the evaporator 41 may absorb heat from ambient air and cool the air in the first flow path P1.

Due to the operation of the blower fan 51, the air of the first flow path P1 cooled by the evaporator 41 may be discharged to the storage compartments 20 and 30.

As above mentioned, the refrigerator 1 may operate the defrost heater 70 and the defrost fan 120 during the defrosting operation. The defrost fan 120 may suction air heated by the defrost heater 70 into the second flow path P2 of the defroster 100, and prevent the air heated by the defrost heater 70 from leaking to the storage compartments 20 and 30. Therefore, it is possible to minimize an increase in the temperature of the storage compartments 20 and 30 during the defrosting operation, and the defrosting efficiency may be increased by the defrost heater 70.

Figure 9:
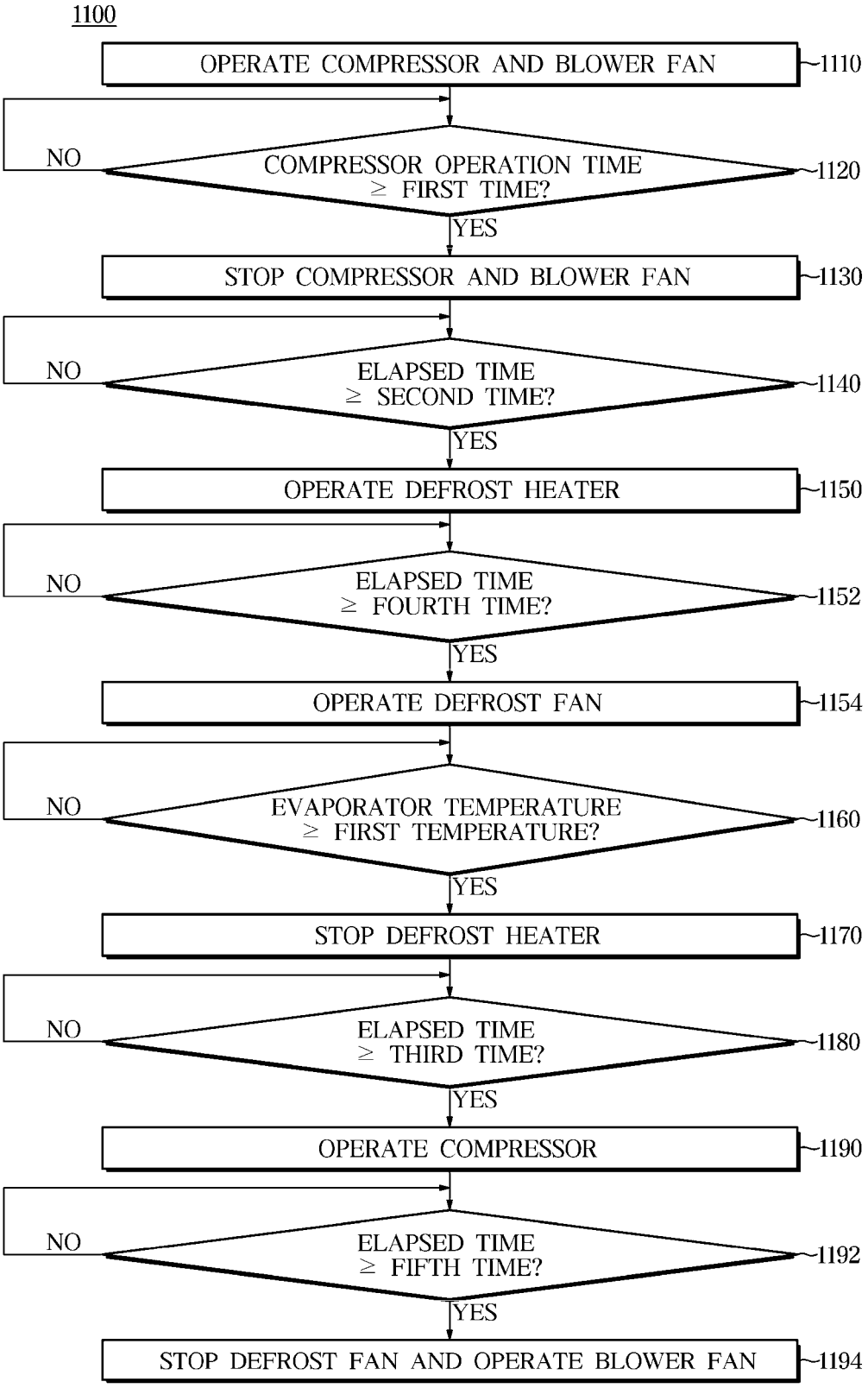
FIG. 9 is a view illustrating an example of cooling/defrosting operations of the refrigerator according to an embodiment of the disclosure.
Figure 10:
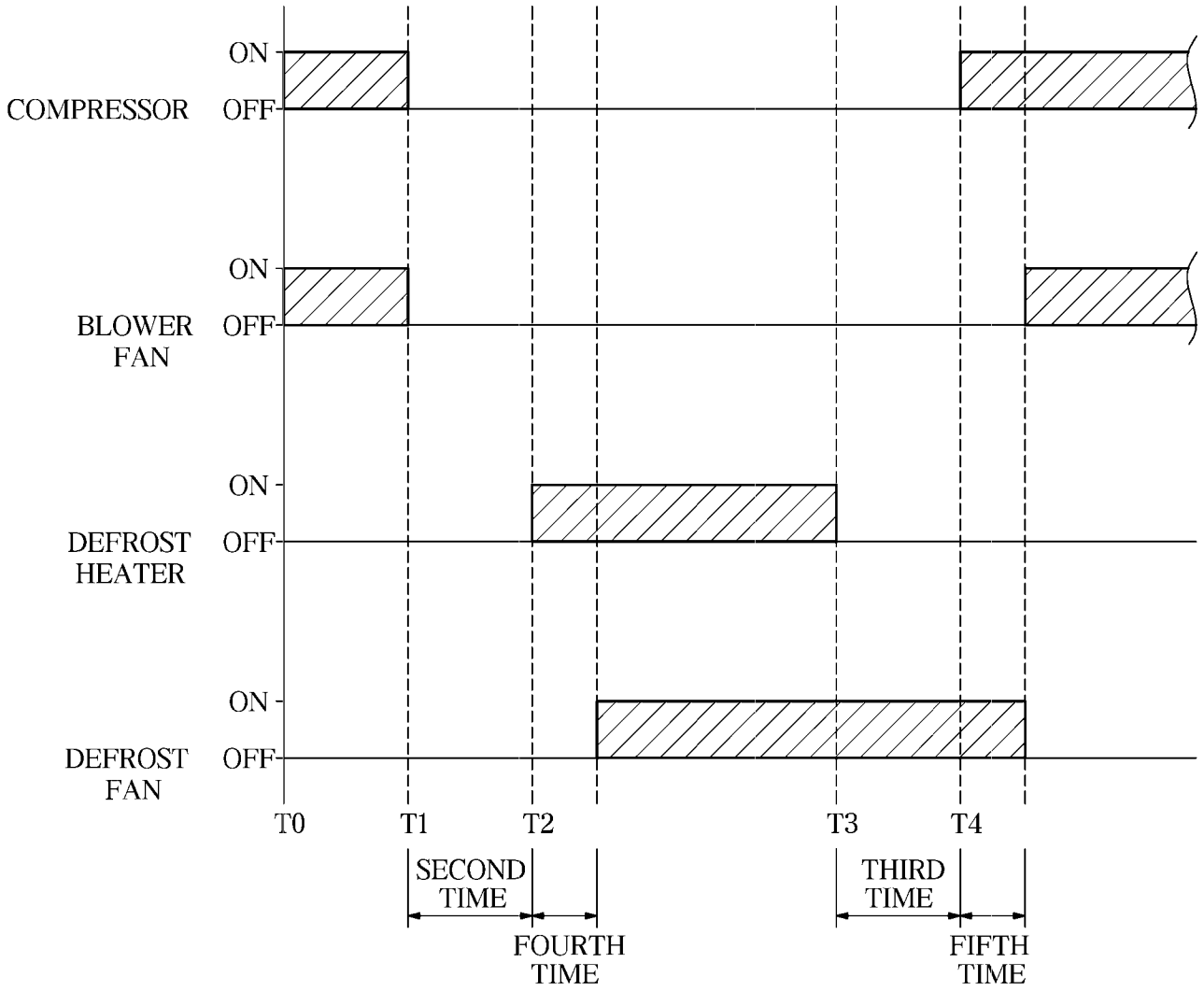
FIG. 10 is a view illustrating an operation of the compressor, the blower fan, the defrost heater, and the defrost fan according to the cooling/defrosting operations of FIG. 9.

FIG. 9 is a view illustrating an example of cooling/defrosting operations of the refrigerator according to an embodiment of the disclosure. FIG. 10 is a view illustrating an operation of the compressor, the blower fan, the defrost heater, and the defrost fan according to the cooling/defrosting operations of FIG. 9.

A cooling/defrosting operation (1100) of the refrigerator 1 will be described with reference to FIGS. 9 and 10.

The refrigerator 1 operates the compressor 42 and the blower fan 51 (1110). The refrigerator 1 identifies whether an operation time of the compressor 42 is greater than or equal to the first time (1120). When the operation time of the compressor 42 is greater than or equal to the first time (yes in 1120), the refrigerator stops the compressor and the blower fan 51 (1130). The refrigerator 1 identifies whether a time elapsed since the compressor 42 is stopped is greater than or equal to the second time (1140).

Operations 1110, 1120, 1130, and 1140 may be the same as the operations 1010, 1020, 1030, and 1040 illustrated in FIG. 7, respectively.

When a time elapsed since the compressor 42 is stopped is greater than or equal to the second time (yes in 1040), the refrigerator 1 operates the defrost heater 70 (1150).

The controller 240 may operate the defrost heater 70 and the defrost fan 120 in response to the elapse of the second time from the stop of the compressor 42. As illustrated in FIG. 10, the controller 240 may operate the defrost heater 70 at a time T2 in which the second time is elapsed since the compressor 42 is stopped.

The controller 240 may remove frost formed on the evaporator 41 by operating the defrost heater 70.

The controller 240 may delay the operation of the defrost fan 120. The air heated by the defrost heater 70 may not be raised immediately after the defrost heater 70 is operated, and the air heated by the defrost heater 70 may not be raised until the defrost heater 70 is operated for a predetermined time. In addition, the air heated by the defrost heater 70 may be cooled by the frost formed on the evaporator 41, and the air in the first flow path P1 may be heated and raised after a sufficient time is elapsed since the defrost heater 70 is operated.

The controller 240 may delay the operation of the defrost fan 120 so that the defrost heater 70 is heated quickly, and the controller 240 may allow the air of the defrost heater 70 to be sufficiently heated. In addition, the controller 240 may delay the operation of the defrost fan 120 in order to prevent unnecessary power consumption by the operation of the defrost fan 120 before the defrost heater 70 is heated.

The refrigerator 1 identifies whether a time elapsed since the defrost heater 70 is operated is greater than or equal to a fourth time (1152).

The controller 240 may count the time elapsed since the defrost heater 70 is operated. The controller 240 may compare the elapsed time with the fourth time.

The fourth time may be set through experiment or experience. For example, the fourth time may be set based on a time corresponding to a period of time until the defrost heater 70 is heated to raise the air in the first flow path P1.

The fourth time may be varied. The fourth time may be shortened based on the temperature of the evaporator 41. For example, when a temperature value of the evaporator 41, which is raised after the start of the defrost heater 70, is greater than or equal to a predetermined value, the controller 240 may shorten the fourth time.

When a time elapsed since the defrost heater 70 is operated is not greater than or equal to the fourth time (no in 1152), the refrigerator 1 waits.

When the time elapsed since the defrost heater 70 is operated is greater than or equal to the fourth time (yes in 1152), the refrigerator 1 operates the defrost fan 120 (1154).

When it is identified that the defrost heater 70 is heated and air is raised in the first flow path P1, the controller 240 may operate the defrost fan 120. The controller 240 may operate the defrost fan 120 in response to the elapse of the fourth time from the start of the defrost heater 70. As illustrated in FIG. 10, the controller 240 may operate the defrost fan 120 at a time T2−1 in which the fourth time is elapsed since the defrost heater 70 is operated.

By operating the defrost fan 120, the controller 240 may prevent the air heated by the defrost heater 70 from leaking into the storage compartments 20 and 30. The defrost fan 120 may suction the air, which is raised by the operation of the defrost heater 70, into the second flow path P2 of the defroster 100 through the inlet 111.

Due to the operation of the defrost fan 120, it is possible to minimize an increase in the temperature of the storage compartments 20 and 30 during the defrosting operation of the refrigerator 1.

The refrigerator 1 identifies whether a temperature of the evaporator 41 is greater than or equal to the first temperature (1160). When the temperature of the evaporator 41 is greater than or equal to the first temperature (yes in 1160), the refrigerator 1 stops the defrost heater 70 (1170). The refrigerator 1 identifies whether a time elapsed since the defrost heater 70 is stopped is greater than or equal to a third time (1180).

Operations 1160, 1170, and 1180 may be the same as the operations 1060, 1070, and 1080 illustrated in FIG. 7, respectively.

When the time elapsed since the defrost heater 70 is stopped is greater than or equal to the third time (yes in 1180), the refrigerator 1 operates the compressor 42 (1190).

When it is identified that all the heat of the defrost heater 70 is exhausted after the defrost heater 70 is stopped, the controller 240 may operate the compressor 42. The controller 240 may operate the compressor 42 and the blower fan 51 in response to the elapse of the third time from the stop of the defrost heater 70. As illustrated in FIG. 10, the controller 240 may operate the compressor 42 at a time T4 in which the third time is elapsed since the defrost heater 70 is stopped.

The controller 240 may delay the operation of the blower fan 51. The evaporator 41 may not cool the air in the first flow path P1 immediately after the compressor 42 is operated, and the evaporator 41 may not cool the air in the first flow path P1 until the compressor 42 is operated for a predetermined time. In addition, the temperature of the ambient air of the defrost heater 70 may still be higher than the temperature of the inside air of the storage compartments 20 and 30.

The controller 240 may delay the operation of the blower fan 51 and extend the operation of the defrost fan 120 in order to prevent the uncooled air from leaking into the storage compartments 20 and 30. By extending the operation of the defrost fan 120, air that is not cooled yet may be bypassed to the second flow path P2 of the defroster 100 and may not leak to the storage compartments 20 and 30.

The refrigerator 1 identifies whether a time elapsed since the compressor 42 is operated is greater than or equal to a fifth time (1192).

The controller 240 may count the time elapsed since the compressor 42 is operated. The controller 240 may compare the elapsed time with the fifth time.

The fifth time may be set through experiment or experience. For example, the fifth time may be set based on a period of time until the temperature of the air in the first flow path P1 becomes lower than the temperature of the air of the storage compartments 20 and 30 because the evaporator 41 is cooled.

The fifth time may be varied. The fifth time may be shortened based on the temperature of the storage compartments 20 and 30 (particularly, the freezing compartment). For example, when the temperature of the storage compartments 20 and 30 is greater than or equal to an upper limit temperature (target temperature+1° C.), the controller 240 may shorten the fifth time.

When the time elapsed since the compressor 42 is operated is not greater than or equal to the fifth time (no in 1192), the refrigerator 1 waits.

When the time elapsed since the compressor 42 is operated is greater than or equal to the fifth time (yes in 1192), the refrigerator 1 stops the defrost fan 120 and operates the blower fan 51 (1194).

When it is identified that the air in the first flow path P1 is cooled by the evaporator 41, the controller 240 may stop the defrost fan 120 and operate the blower fan 51. The controller 240 may stop the defrost fan 120 and operate the blower fan 51 in response to the elapse of the fifth time from the start of the compressor 42. As illustrated in FIG. 10, the controller 240 may stop the defrost fan 120 and operate the blower fan 51 at a time T4−1 in which the fifth time is elapsed since the compressor 42 is operated.

The controller 240 may discharge the air cooled by the evaporator 41 to the storage compartments 20 and 30 by operating the blower fan 51.

As above described, the refrigerator 1 may delay the operation of the defrost fan 120 at the start of the defrosting operation. Therefore, heating of the defrost heater 70 may be promoted, and power consumption may be reduced due to the operation of the defrost fan 120. In addition, the refrigerator 1 may delay the stop of the defrost fan 120 and the operation of the blower fan 51 after the end of the defrosting operation. Therefore, the refrigerator 1 may prevent that the air of the cooling duct 50 flows into the storage compartments 20 and 30 before the evaporator 41 is cooled.

Figure 11:
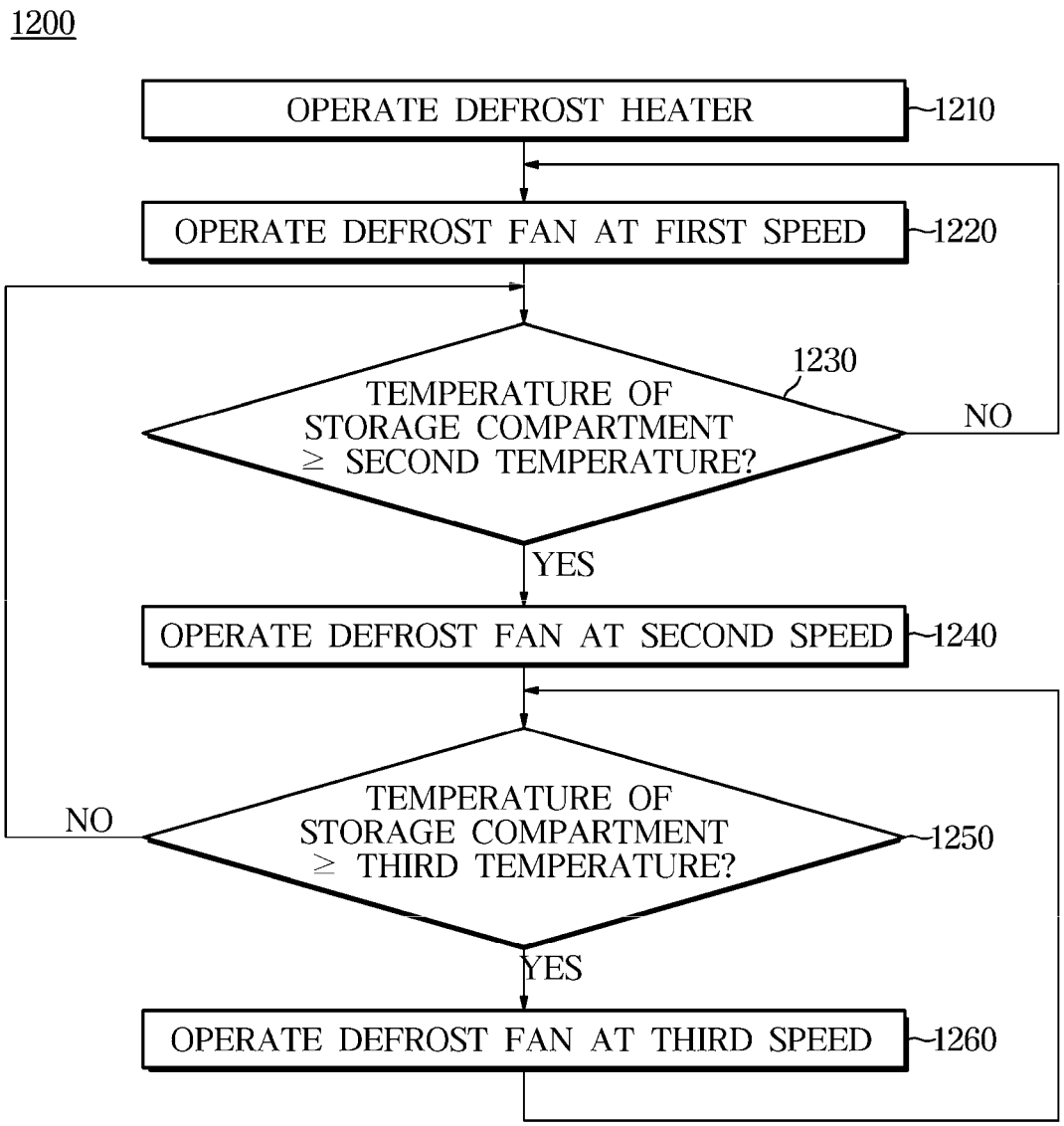
FIG. 11 is a view illustrating an example of the defrosting operation of the refrigerator according to an embodiment of the disclosure.
Figure 12:
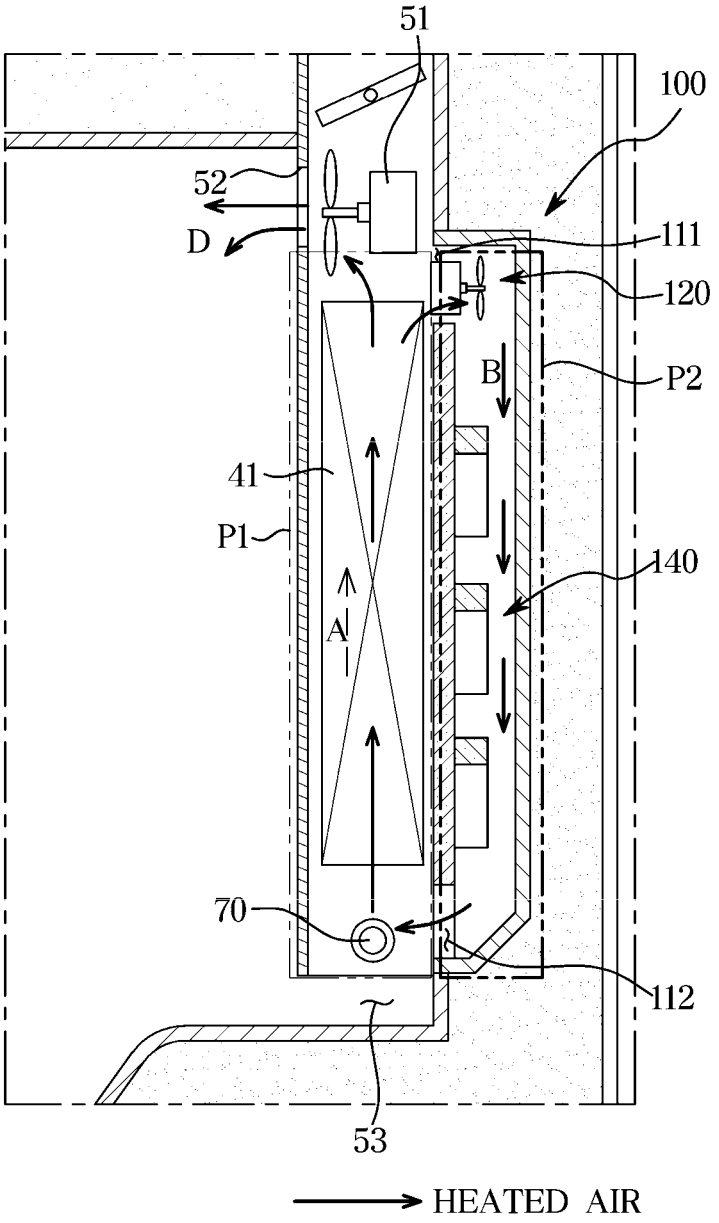
FIG. 12 is a view illustrating an air flow by the defrosting operation of FIG. 11.

FIG. 11 is a view illustrating an example of the defrosting operation of the refrigerator according to an embodiment of the disclosure. FIG. 12 is a view illustrating an air flow by the defrosting operation of FIG. 11.

During the defrosting operation, the refrigerator 1 may vary the rotational speed of the defrost fan 120. For example, the refrigerator 1 may increase or decrease the rotational speed of the defrost fan 120 based on the temperature of the storage compartments 20 and 30.

A defrosting operation (1200) of the refrigerator 1 will be described with reference to FIGS. 11 and 12.

The refrigerator 1 operates the defrost heater 70 (1210).

For example, the controller 240 may calculate an operation time of the compressor 42 during the cooling operation, and stop the compressor 42 and the blower fan 51 in response to the operation time of the compressor 42 being greater than or equal to the first time. In addition, the controller 240 may operate the defrost heater 70 to remove frost formed on the evaporator 41.

The refrigerator 1 operates the defrost fan 120 at a first speed (1220).

The controller 240 may operate the defrost fan 120 at the first speed so that the air heated by the defrost heater 70 is prevented from leaking to the storage compartments 20 and 30 and the air heated by the defrost heater 70 flows into the defroster 100.

The first speed may be set through experiment or experience. For example, the first speed may be set based on the amount of air raised by the heated defrost heater 70. Particularly, the first speed may be set to a certain speed that is to suction air, which is the same or similar amount as the amount of air raised by the defrost heater 70, into the defroster 100.

The refrigerator 1 identifies whether a temperature of the storage compartments 20 and 30 is greater than or equal to a second temperature (1230).

When the temperature of the defrost heater 70 is increased while the defrost fan 120 is operated at the first speed, the air heated by the defrost heater 70 may flow into the storage compartments 20 and 30. For example, as the temperature of the defrost heater 70 is increased, the amount of air raised in the first flow path P1 may increase. When the amount of air raised in the first flow path P1 exceeds an amount of air suctioned by the defrost fan 120, a portion of the air heated by the defrost heater 70 may be moved in a third direction A and may leak into the storage compartments 20 and 30, as illustrated in FIG. 12.

The controller 240 may identify whether the temperature of the storage compartments 20 and 30 is greater than or equal to the second temperature, in order to identify whether the air heated by the defrost heater 70 leaks into the storage compartments 20 and 30. For example, the controller 240 may identify whether the temperature of the freezing compartment 30 is greater than or equal to the second temperature. During the defrosting operation of the refrigerator 1, the controller 240 may receive a signal related to the temperature of the freezing compartment 30 from the freezing compartment temperature sensor 232 and identify the temperature of the freezing compartment 30 based on the received signal. The controller 240 may compare the temperature of the freezing compartment 30 with the second temperature.

The second temperature may be set through experiment or experience. For example, the second temperature may be a temperature that is higher than a target temperature set by a user so as to indicate that air, which is heated by the defrost heater 70, leaks to the storage compartments 20 and 30 when the defrost fan 120 is operated at the first speed.

When the temperature of the storage compartments 20 and 30 is not greater than or equal to the second temperature (no in 1230), the refrigerator 1 continues to operate the defrost fan 120 at the first speed.

When the temperature of the storage compartments 20 and 30 is greater than or equal to the second temperature (yes in 1230), the refrigerator 1 operates the defrost fan 120 at a second speed (1240).

When the temperature of the storage compartments 20 and 30 is greater than or equal to the second temperature, it may be identified that the air heated by the defrost heater 70 leaks into the storage compartments 20 and 30 even though the defrost fan 120 is operated at the first speed.

The controller 240 may increase the speed of the defrost fan 120 in response to the temperature of the storage compartments 20 and 30 being greater than or equal to the second temperature. By increasing the speed of the defrost fan 120, the controller 240 may increase an intake amount of air that is heated by the defrost heater 70 and suctioned to the defroster 100. Accordingly, the amount of air leaking into the storage compartments 20 and 30 may be reduced.

The second speed may be greater than the first speed and may be set through experiment or experience. For example, the second speed may be set based on the amount of the air raised by the heated defrost heater 70.

The refrigerator 1 identifies whether the temperature of the storage compartments 20 and 30 is greater than or equal to a third temperature (1250).

When the temperature of the defrost heater 70 is further increased although the defrost fan 120 is operated at the second speed, the air heated by the defrost heater 70 may leak into the storage compartments 20 and 30. For example, as the temperature of the defrost heater 70 becomes higher, the amount of air raised in the first flow path P1 may further increase. A portion of the air heated by the defrost heater 70 may leak into the storage compartments 20 and 30.

The third temperature may be higher than the second temperature, and by identifying whether the temperature of the storage compartments 20 and 30 is greater than or equal to the third temperature, the controller 240 may identify whether the air heated by the defrost heater 70 leaks to the storage compartments 20 and 30. For example, the controller 240 may identify whether the temperature of the freezing compartment 30 is greater than or equal to a third temperature.

The third temperature may be set through experiment or experience. For example, the third temperature may higher than the second temperature in order to indicate that the air heated by the defrost heater 70 leaks to the storage compartments 20 and 30 when the defrost fan 120 is operated at the second speed.

When the temperature of the storage compartments 20 and 30 is not greater than or equal to the third temperature (no in 1250), the refrigerator 1 identifies whether the temperature of the storage compartments 20 and 30 is greater than or equal to the second temperature and continue to operate the defrost fan 120 at the second speed.

When the temperature of the storage compartments 20 and 30 is greater than or equal to the third temperature (yes in 1250), the refrigerator 1 operates the defrost fan 120 at a third speed (1260).

When the temperature of the storage compartments 20 and 30 is greater than or equal to the third temperature, it may be identified that the air heated by the defrost heater 70 still leaks into the storage compartments 20 and 30 even though the defrost fan 120 is operated at the second speed.

The controller 240 may further increase the speed of the defrost fan 120 in response to the temperature of the evaporator 41 being greater than or equal to the third temperature. The controller 240 may operate the defrost fan 120 at the third speed.

The third speed may be greater than the second speed. The controller 240 may increase the amount of air suctioned into the defroster 100 by increasing the rotational speed of the defrost fan 120. Therefore, the amount of air leaking into the storage compartments 20 and 30 may be reduced.

The third speed may be greater than the second speed and may be set through experiment or experience. For example, the third speed may be set based on the amount of the air raised by the heated defrost heater 70.

Thereafter, the refrigerator 1 may repeat identifying whether the temperature of the storage compartments 20 and 30 is greater than or equal to the third temperature.

As described above, the refrigerator 1 is described to accelerate the defrost fan 120 to the first speed, the second speed, and the third speed, but is not limited thereto. For example, the refrigerator 1 may accelerate the defrost fan 120 to various levels of speeds according to the temperature of the storage compartments 20 and 30.

In addition, the refrigerator 1 is described to gradually increases the rotational speed of the defrost fan 120, but is not limited thereto. For example, the refrigerator 1 may linearly increase the rotational speed of the defrost fan 120 according to the temperature of the storage compartments 20 and 30.

As above described, the refrigerator 1 may change the rotational speed of the defrost fan 120 based on the temperature of the storage compartments 20 and 30 during the defrosting operation. For example, the refrigerator 1 may increase the rotational speed of the defrost fan 120 in response to an increase in the temperature of the storage compartments 20 and 30 during the defrosting operation. Accordingly, it is possible to prevent an increase in the temperate of the storage compartments 20 and 30 caused by the leakage of the air, which is heated by the defrost heater 70, into the storage compartments 20 and 30.

Figure 13:
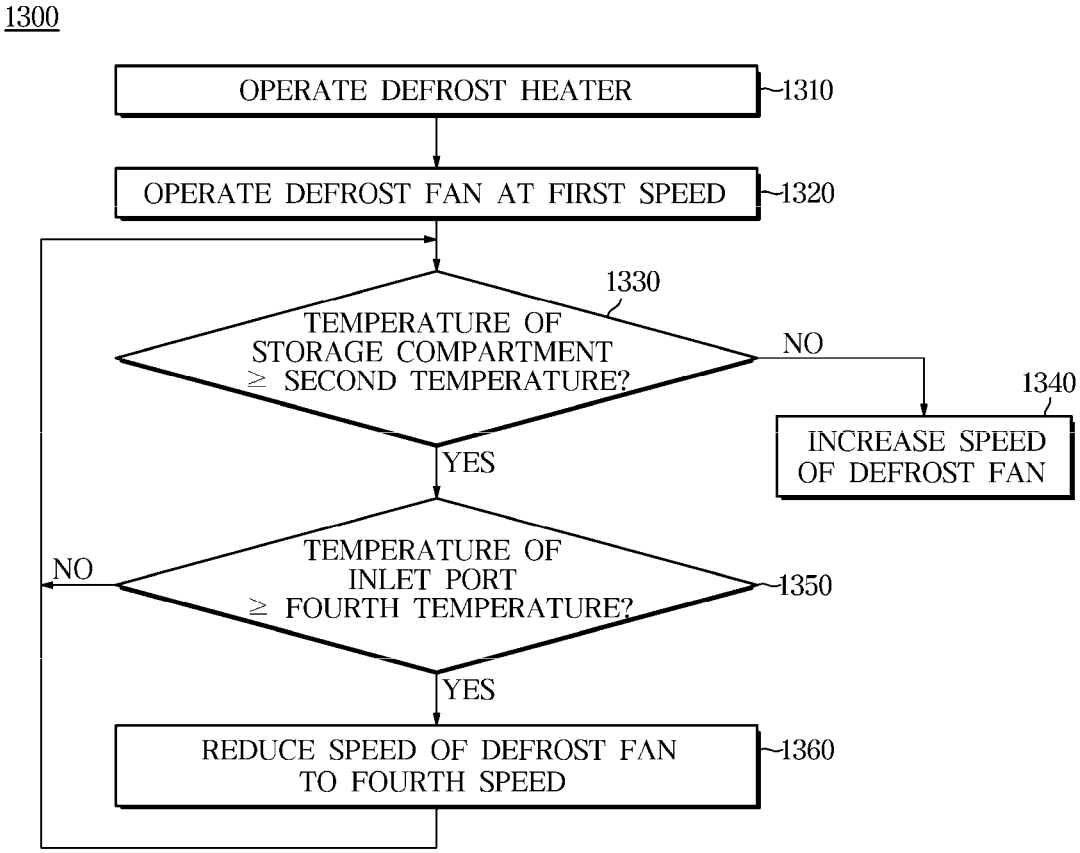
FIG. 13 is a view illustrating an example of the defrosting operation of the refrigerator according to an embodiment of the disclosure.
Figure 14:
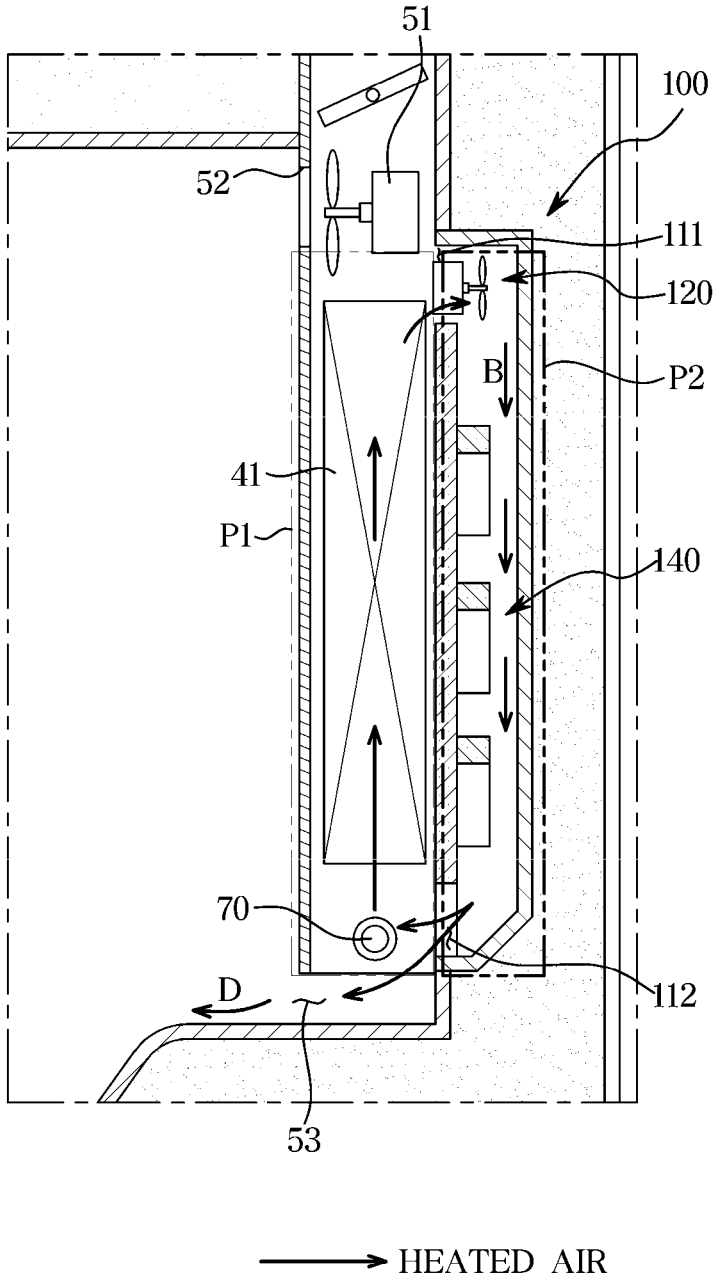
FIG. 14 is a view illustrating an air flow by the defrosting operation of FIG. 13.

FIG. 13 is a view illustrating an example of the defrosting operation of the refrigerator according to an embodiment of the disclosure. FIG. 14 is a view illustrating an air flow by the defrosting operation of FIG. 13.

During the defrosting operation, the refrigerator 1 may increase or decrease the rotational speed of the defrost fan 120 based on the temperature of the inlet port 53.

A defrosting operation (1300) of the refrigerator 1 will be described with reference to FIGS. 13 and 14.

The refrigerator 1 operates the defrost heater 70 (1310). The refrigerator 1 operates the defrost fan 120 at a first speed (1320). The refrigerator 1 identifies whether the temperature of the storage compartments 20 and 30 is greater than or equal to a second temperature (1330).

Operations 1310, 1320, and 1330 may be the same as the operations 1210, 1220, and 1230 illustrated in FIG. 11, respectively.

When the temperature of the storage compartments 20 and 30 is greater than or equal to the second temperature (yes in 1330), the refrigerator 1 increases the rotational speed of the defrost fan 120 (1340).

When the temperature of the storage compartments 20 and 30 is greater than or equal to the second temperature, it may be identified that the air heated by the defrost heater 70 leaks into the storage compartments 20 and 30 even though the defrost fan 120 is operated at the first speed.

As illustrated FIG. 11, the controller 240 may increase the speed of the defrost fan 120 in response to the temperature of the evaporator 41 being greater than or equal to the second temperature.

When the temperature of the storage compartments 20 and 30 is not greater than or equal to the second temperature (no in 1330), the refrigerator 1 identifies whether the temperature of the inlet port 53 is greater than or equal to a fourth temperature (1350).

When the temperature of the storage compartments 20 and 30 is not greater than or equal to the second temperature, the controller 240 continues to operate the defrost fan 120 at the first speed.

When the defrost fan 120 is operated before the air of the first flow path P1 is sufficiently heated after the defrost heater 70 is operated, air, which is discharged to the outlet 112 by the defrost fan 120, may be moved in a fourth direction D and then discharged to the storage compartments 20 and 30 through the inlet port 53 of the cooling duct 50, as illustrated in FIG. 14. In other words, when the air heated by the defrost heater 70 is suctioned into the defroster 100 by the defrost fan 120 and discharged through the outlet port 112, the air, which is discharged through the outlet 112, may be discharged into the storage compartments 20 and 30 through the inlet port 53 of the cooling duct 50. Accordingly, the temperature of the storage compartments 20 and 30 may be increased.

The controller 240 may identify whether the temperature of the inlet port 53 is greater than or equal to a fourth temperature, in order to identify whether air, which is suctioned into the defroster 100 through the defrost fan 120, leaks into the storage compartments 20 and 30. During the defrosting operation of the refrigerator 1, the controller 240 may receive a signal related to the temperature of the inlet port 53 from the inlet temperature sensor 234, and identify the temperature of the inlet port 53 based on the received signal. The controller 240 may compare the temperature of the inlet port 53 with the fourth temperature.

The fourth temperature may be set through experiment or experience. For example, the fourth temperature may be a temperature that is higher than a target temperature set by a user so as to indicate that air, which is heated by the defrost heater 70, leaks to the storage compartments 20 and 30.

When the temperature of the inlet port 53 is not greater than or equal to the fourth temperature (no in 1350), the refrigerator 1 continues to monitor the temperature of the storage compartments 20 and 30.

When the temperature of the inlet port 53 is greater than or equal to the fourth temperature (yes in 1350), the refrigerator 1 operates the defrost fan 120 at the fourth speed (1360).

When the temperature of the inlet port 53 is greater than or equal to the fourth temperature, it may be identified that the air heated by the defrost heater 70 is suctioned into the defroster 100 by the defrost fan 120, and discharged to the storage compartments 20 and 30 through the inlet port 53 of the cooling duct 50.

The controller 240 may reduce the speed of the defrost fan 120 in response to the temperature of the inlet port 53 being greater than or equal to the fourth temperature. The controller 240 may reduce a discharge amount of the air discharged through the outlet 112 of the defroster 100 by reducing the speed of the defrost fan 120. Therefore, the air discharged through the outlet 112 of the defroster 100 may be prevented from leaking to the storage compartments 20 and 30 through the inlet port 53 of the cooling duct 50.

The fourth speed may be less than the first speed and may be set through experiment or experience. For example, the fourth speed may be set based on the amount of air discharged through the outlet 112 of the defroster 100 by the defrost fan 120.

Thereafter, the refrigerator 1 continues to monitor the temperature of the storage compartments 20 and 30.

As described above, the refrigerator 1 is described to decelerate the defrost fan 120 to the fourth speed, but is not limited thereto. For example, the refrigerator 1 may decelerate the defrost fan 120 to various levels of speed according to the temperature of the inlet port 53.

In addition, the refrigerator 1 is described to gradually decrease the rotational speed of the defrost fan 120, but is not limited thereto. For example, the refrigerator 1 may linearly decrease the rotational speed of the defrost fan 120 according to the temperature of the inlet port 53.

As above described, the refrigerator 1 may change the rotation speed of the defrost fan 120 based on the temperature of the inlet port 53 during the defrosting operation. For example, the refrigerator 1 may decrease the rotational speed of the defrost fan 120 in response to an increase in the temperature of the inlet port 53 during the defrosting operation. Accordingly, it is possible to prevent an increase in the temperate of the storage compartments 20 and 30 caused by the leakage of the air, which is heated by the defrost heater 70, into the storage compartments 20 and 30 through the inlet port 53.

Figure 15:
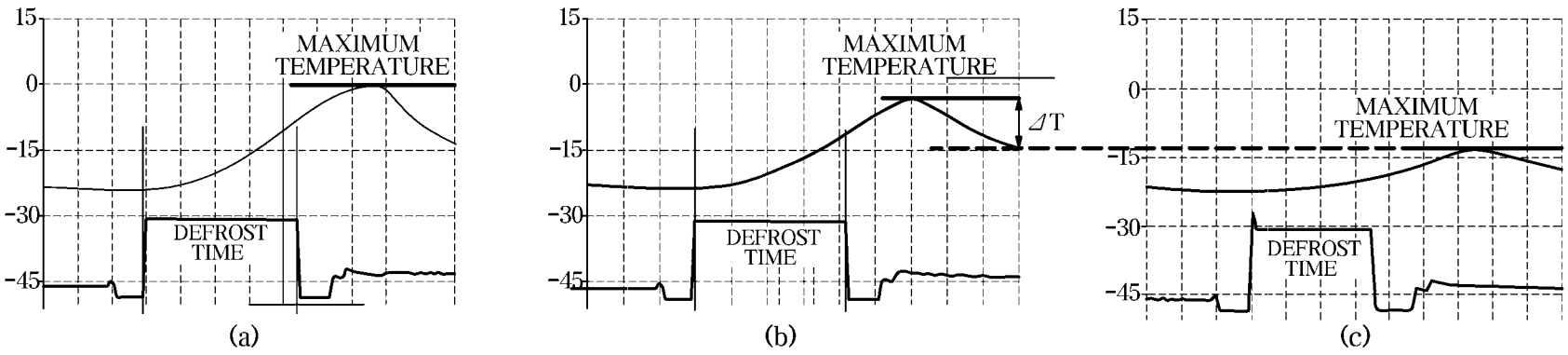
FIG. 15 is a view illustrating a case in which a defrost time is reduced by the defrosting operation of the refrigerator according to an embodiment of the disclosure.

FIG. 15 is a view illustrating a case in which a defrost time is reduced by the defrosting operation of the refrigerator according to an embodiment of the disclosure. FIG. 15A illustrates the temperature of the storage compartments 20 and 30 when the defrost fan 120 is not operated, FIG. 15B illustrates the temperature of the storage compartments 20 and 30 when the defrost fan 120 is operated at a constant speed, and FIG. 15C illustrates the temperature of the storage compartments 20 and 30 when the defrost fan 120 is operated at a variable speed.

When the defrost fan 120 is not operated, the temperature of the storage compartments 20 and 30 may be raised to approximately 0° C., as illustrated in FIG. 15A.

When the defrost fan 120 is operated at a constant speed, the temperature of the storage compartments 20 and 30 may be raised to approximately −3° C., as illustrated in FIG. 15B.

On the other hand, when the defrost fan 120 is operated at a variable speed, the temperature of the storage compartments 20 and 30 may be raised to approximately −15° C., as illustrated in FIG. 15C. In addition, a defrost time until the temperature of the evaporator 41 reaches the first temperature may be reduced.

The refrigerator may include the storage compartment; the first flow path separated from the storage compartment; the evaporator provided on the first flow path; the compressor configured to discharge a refrigerant to the evaporator; the blower fan configured to discharge air from the first flow path to the storage compartment; the defrost heater provided on the first flow path to heat the evaporator; the second flow path separated from the first flow path; the defrost fan configured to suction air from the first flow path into the second flow path; and the controller configured to alternately perform the cooling operation and the defrosting operation, configured to operate the compressor and the blower fan during the cooling operation, configured to operate the defrost heater and the defrost fan during the defrosting operation, and configured to vary a rotational speed of the defrost fan. By varying the rotational speed of the defrost fan, the refrigerator prevents the air heated by the defrost heater from leaking into the storage compartment, thereby preventing an increase in the temperature of the storage compartment.

The controller may vary the rotational speed of the defrost fan based on the temperature of the storage compartment. The controller may increase the rotational speed of the defrost fan in response to an increase in the temperature of the storage compartment. By varying the rotational speed of the defrost fan based on the temperature of the storage compartment, the refrigerator may prevent the air heated by the defrost heater from leaking into the storage compartment through the outlet port of the first flow path.

The controller may vary the rotational speed of the defrost fan based on the temperature of the inlet port of the first flow path. The controller may reduce the rotational speed of the defrost fan in response to an increase in the temperature of the inlet port of the first flow path. By varying the rotational speed of the defrost fan based on the temperature of the inlet port of the first flow path, the refrigerator may prevent the air heated by the defrost heater from leaking to the storage compartment through the inlet port of the first flow path.

The controller may operate the defrost heater when the first time is elapsed since the compressor and the blower fan are stopped, and operate the defrost fan when the second time is elapsed since the defrost heater is operated. The second time may be varied based on the temperature of the evaporator. By delaying the operation of the defrost fan, the refrigerator may prevent power consumption due to the operation of the defrost fan before the defrost heater is heated.

The controller may operate the compressor when the third time is elapsed since the defrost heater is stopped, and stop the defrost fan and operate the blower fan when the fourth time is elapsed since the compressor is operated. The fourth time may be varied based on the temperature of the storage compartment. By delaying the operation of the blower fan, the refrigerator may prevent the residual heat remaining in the defrost heater from leaking into the storage compartment.

The controller may perform the defrosting operation in response to the operation time of the compressor being greater than or equal to the first time, and may perform the cooling operation in response to the temperature of the evaporator being greater than or equal to the first temperature.

As is apparent from the above description, the refrigerator may include the defroster capable of improving the defrosting efficiency.

The refrigerator may improve power consumption by minimizing defrost energy by shortening a defrost time.

The refrigerator may improve performance of the food storage by preventing an increase in a temperature of the storage compartment caused by defrost heat.

Although a few embodiments of the disclosure have been shown and described, it would be appreciated by those skilled in the art that changes may be made in these embodiments without departing from the principles and spirit of the disclosure, the scope of which is defined in the claims and their equivalents.

Exemplary embodiments of the present disclosure have been described above. In the exemplary embodiments described above, some components may be implemented as a "module". Here, the term 'module' means, but is not limited to, a software and/or hardware component, such as a Field Programmable Gate Array (FPGA) or Application Specific Integrated Circuit (ASIC), which performs certain tasks. A module may advantageously be configured to reside on the addressable storage medium and configured to execute on one or more processors.

Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The operations provided for in the components and modules may be combined into fewer components and modules or further separated into additional components and modules. In addition, the components and modules may be implemented such that they execute one or more CPUs in a device.

With that being said, and in addition to the above described exemplary embodiments, embodiments can thus be implemented through computer readable code/instructions in/on a medium, e.g., a computer readable medium, to control at least one processing element to implement any above described exemplary embodiment. The medium can correspond to any medium/media permitting the storing and/or transmission of the computer readable code.

The computer-readable code can be recorded on a medium or transmitted through the Internet. The medium may include Read Only Memory (ROM), Random Access Memory (RAM), Compact Disk-Read Only Memories (CD-ROMs), magnetic tapes, floppy disks, and optical recording medium. Also, the medium may be a non-transitory computer-readable medium. The media may also be a distributed network, so that the computer readable code is stored or transferred and executed in a distributed fashion. Still further, as only an example, the processing element could include at least one processor or at least one computer processor, and processing elements may be distributed and/or included in a single device.

While exemplary embodiments have been described with respect to a limited number of embodiments, those skilled in the art, having the benefit of this disclosure, will appreciate that other embodiments can be devised which do not depart from the scope as disclosed herein. Accordingly, the scope should be limited only by the attached claims.

What is claimed is:

1. A refrigerator comprising:

a storage compartment;

a first air flow path provided outside the storage compartment;

a second air flow path having at least a portion separated from the first air flow path;

an evaporator provided on the first flow path and configured to evaporate a refrigerant to cool air for the storage compartment;

a compressor configured to compress the refrigerant;

a first fan configured to discharge the air cooled by the evaporator from the first air flow path to the storage compartment;

a heater configured to heat the evaporator to defrost the evaporator;

a second fan configured to blow air heated by the heater from the first air flow path into the second air flow path; and a controller configured to:

alternately perform a cooling operation and a defrosting operation, operate the compressor and the first fan during the cooling operation, operate the heater and the second fan during the defrosting operation, and change a rotational speed of the second fan in response to a change in a temperature of the storage compartment during the defrosting operation.

2. The refrigerator of claim 1, wherein the first air flow path is provided to discharge the cooled air into the storage compartment, and the second air flow path is provided to avoid discharging the heated air into the storage compartment.

3. The refrigerator of claim 1, wherein the controller is configured to increase the rotational speed of the second fan in response to an increase in the temperature of the storage compartment during the defrosting operation.

4. The refrigerator of claim 1, wherein the controller is configured to reduce the rotational speed of the second fan in response to an increase in a temperature in the first air flow path.

5. The refrigerator of claim 1, wherein the controller is configured to:

operate the heater after the compressor and the first fan have been stopped for a first predetermined time, and operate the second fan while the heater is operated and after the heater has been stopped for a second predetermined time.

6. The refrigerator of claim 5, wherein the second predetermined time is based on a temperature of the evaporator.

7. The refrigerator of claim 1, wherein the controller is configured to:

operate the compressor after the heater has been stopped for a first predetermined time, and stop the second fan and operate the first fan after the compressor has been operated for a second predetermined time.

8. The refrigerator of claim 7, wherein the fourth second predetermined time is determined based on a temperature of the storage compartment.

9. The refrigerator of claim 1, wherein the controller is configured to:

perform the defrosting operation in response to an operation time of the compressor being greater than or equal to a first predetermined time, and perform the cooling operation in response to a temperature of the evaporator being greater than or equal to a first predetermined temperature.

10. A refrigerator comprising:

a storage compartment;

a first air flow path provided outside the storage compartment;

a second air flow path having at least a portion separated from the first air flow path;

an evaporator provided on the first flow path and configured to evaporate a refrigerant to cool air for the storage compartment;

a compressor configured to compress the refrigerant;

a first fan configured to discharge the air cooled by the evaporator from the first air flow path to the storage compartment;

a heater configured to heat the evaporator to defrost the evaporator;

a second fan configured to blow air heated by the heater from the first air flow path into the second air flow path; and a controller configured to:

alternately perform a cooling operation and a defrosting operation, operate the compressor and the first fan during the cooling operation, operate the heater and the second fan during the defrosting operation, operate the heater after the compressor and the first fan have been stopped for a first predetermined time, and second fan while the heater is operated and after the heater has been stopped for a second predetermined time.

11. The refrigerator of claim 10, wherein the first air flow path is provided to discharge the cooled air into the storage compartment, and the second air flow path is provided to avoid discharging the heated air into the storage compartment.

12. The refrigerator of claim 10, wherein the controller is configured to delay operating the second fan until the heater has been operated for a third predetermined time.

13. The refrigerator of claim 10, wherein the controller is configured to continue to operate the compressor after the second predetermined time has elapsed while the compressor is operated for a third predetermined time.

14. The refrigerator of claim 10, wherein the controller is configured to increase the rotational speed of the second fan in response to an increase in a temperature of the storage compartment.

15. The refrigerator of claim 10, wherein the controller is configured to reduce the rotational speed of the second fan in response to an increase in a temperature in the first air flow path.

* * * * *